United States Patent [19]

Zachary

[11] 4,082,134

[45] Apr. 4, 1978

[54] COMBINED SAND CORE MACHINE

[75] Inventor: William A. Zachary, Walled Lake, Mich.

[73] Assignee: International Minerals & Chemical Corporation, Detroit, Mich.

[21] Appl. No.: 735,950

[22] Filed: Oct. 27, 1976

[51] Int. Cl.[2] ..... B22C 13/00; B22C 13/08

[52] U.S. Cl. ..... 164/157; 164/16; 164/165; 164/183; 164/186; 164/201

[58] Field of Search ..... 164/16, 165, 166, 200, 164/201, 202, 186, 154, 155, 183, 157

[56] References Cited

U.S. PATENT DOCUMENTS

| | | | |
|---|---|---|---|
| 1,717,325 | 6/1929 | Ryan | 164/201 |
| 3,040,394 | 6/1962 | Hornig | 164/165 |
| 3,096,547 | 7/1963 | Hunter et al. | 164/200 |
| 3,511,302 | 5/1970 | Barron | 164/24 |
| 3,528,481 | 9/1970 | Lund | 164/200 |
| 3,556,195 | 1/1971 | Lund | 164/201 |

*Primary Examiner*—Francis S. Husar
*Assistant Examiner*—John McQuade
*Attorney, Agent, or Firm*—Schuyler, Birch, Swindler, McKie & Beckett

[57] ABSTRACT

A machine is disclosed for producing rigid sand cores from a molding mixture of a refractory granular material such as sand and a hardenable binder. These rigid sand cores then are used in foundries for metal casting. The machine of the present invention is capable of producing several different types of rigid sand cores including hollow shell sand cores, hot box cores and cold box cores. The machine includes means for curing the molding mixture used to produce shell sand cores and hot box cores by applying heat to the molding mixture after it is placed in a core or molding box. Other means are provided in the machine for curing cold box cores by applying a gas catalyst to the molding mixture after it is placed in the core box. The machine of the present invention is automatically controlled by a circuit arrangement which can be programmed by the machine operator. A selector switch in the circuit arrangement enables the machine operator to select the type of operation to be performed by the machine, that is, the production of one of at least three types of sand cores including shell sand cores, hot box cores, or cold box cores. The circuit arrangement further includes a plurality of timers which can be reprogrammed for each of the different operations performed on the machine. Thus, a high degree of circuit economy is achieved by using many of the circuit elements to perform multiple functions and by using other circuit elements to perform the same function in each of the different operations performed on the machine.

30 Claims, 19 Drawing Figures

HOT BOX AND SHELL CORE PROCESSES

COLD BOX PROCESS

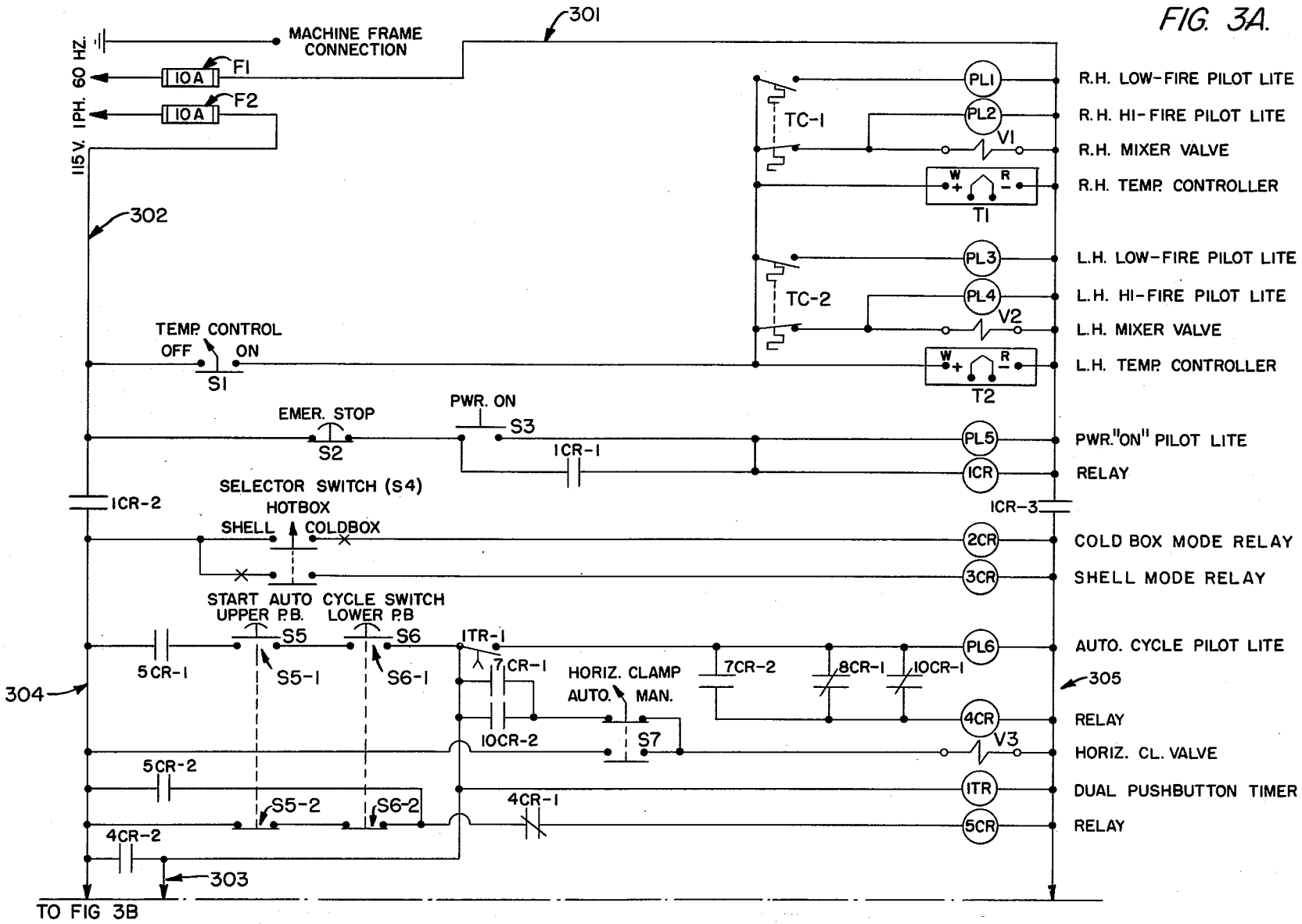
FIG. 3A.
R.H. LOW-FIRE PILOT LITE
R.H. HI-FIRE PILOT LITE
R.H. MIXER VALVE
R.H. TEMP. CONTROLLER
L.H. LOW-FIRE PILOT LITE
L.H. HI-FIRE PILOT LITE
L.H. MIXER VALVE
L.H. TEMP. CONTROLLER
PWR."ON" PILOT LITE
RELAY
COLD BOX MODE RELAY
SHELL MODE RELAY
AUTO. CYCLE PILOT LITE
306
RELAY
HORIZ. CL. VALVE
DUAL PUSHBUTTON TIMER
RELAY
PL1
PL2
V1
T1
PL3
PL4
V2
T2
PL5
ICR
ICR-3
2CR
3CR
PL6
4CR
V3
ITR
5CR
TC-1
TC-2
10CR-1
8CR-1
7CR-2
HORIZ. CLAMP
MAN.
AUTO.
S7
ICR-1
PWR. ON
S3
7CR-1
10CR-2
4CR-1
ITR-1
301
MACHINE FRAME CONNECTION
EMER. STOP
S2
SELECTOR SWITCH (S4)
HOTBOX
COLDBOX
SHELL
START AUTO CYCLE SWITCH
UPPER P.B.
LOWER P.B.
S6
S6-1
S6-2
S5
S5-1
S5-2
F1
F2
10A
10A
TEMP. CONTROL
ON
OFF
S1
302
ICR-2
5CR-1
5CR-2
4CR-2
303
304
115V. 1PH. 60 HZ.
TO FIG 3B

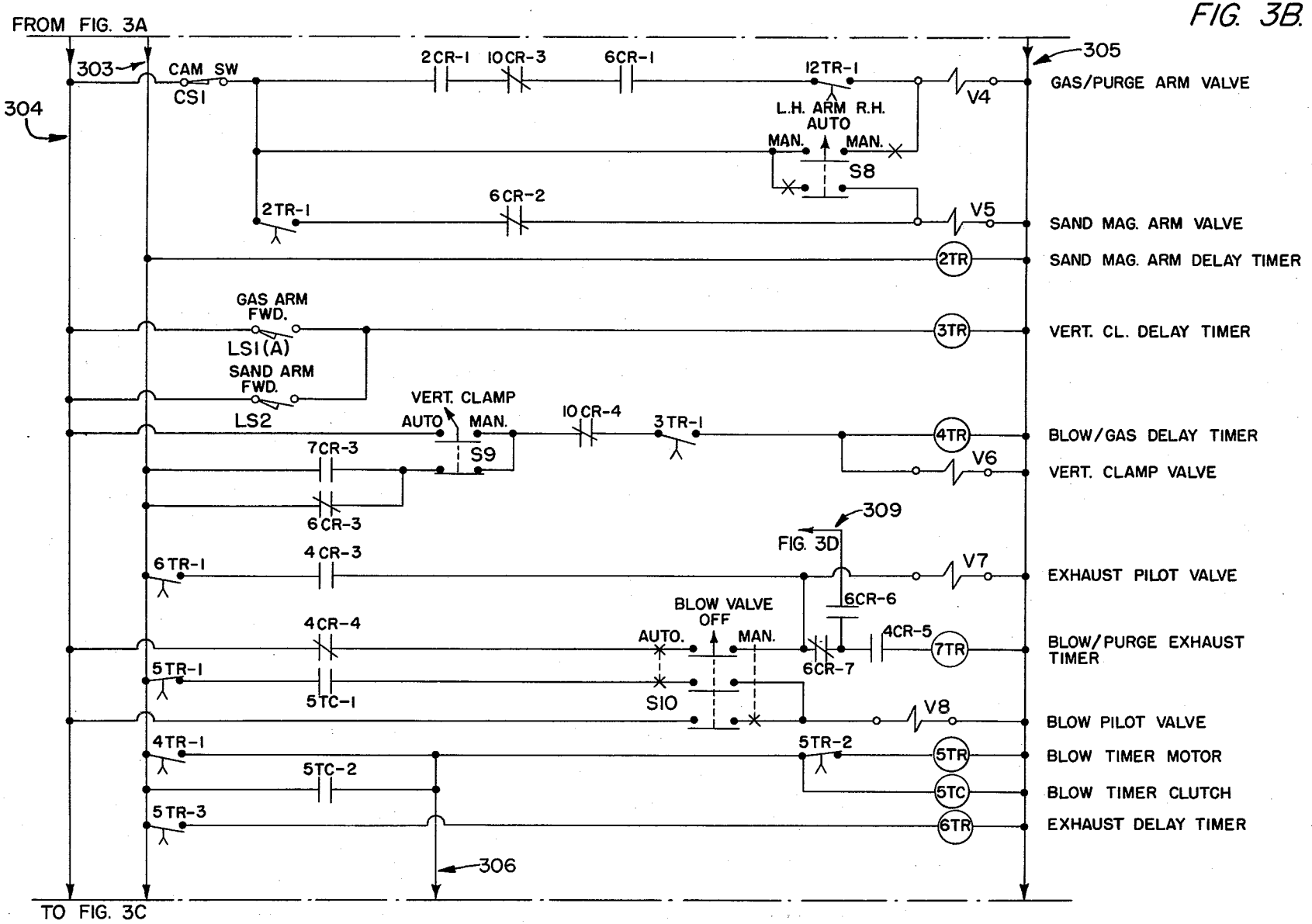
FIG. 3B
305
GAS/PURGE ARM VALVE
SAND MAG. ARM VALVE
SAND MAG. ARM DELAY TIMER
VERT. CL. DELAY TIMER
BLOW/GAS DELAY TIMER
VERT. CLAMP VALVE
EXHAUST PILOT VALVE
BLOW/PURGE EXHAUST TIMER
BLOW PILOT VALVE
BLOW TIMER MOTOR
BLOW TIMER CLUTCH
EXHAUST DELAY TIMER
V4
V5
V6
V7
V8
2TR
3TR
4TR
7TR
5TR
5TC
6TR
12TR-1
L.H. ARM R.H.
AUTO
MAN.
S8
6CR-1
2CR-1
10CR-3
6CR-2
2TR-1
CAM SW
CS1
FROM FIG. 3A
303
304
GAS ARM FWD.
LS1(A)
SAND ARM FWD.
LS2
3TR-1
10CR-4
VERT. CLAMP
S9
7CR-3
6CR-3
4CR-3
4CR-4
5TC-1
5TC-2
6TR-1
5TR-1
4TR-1
5TR-3
309
FIG. 3D
6CR-6
4CR-5
6CR-7
BLOW VALVE OFF
S10
5TR-2
306
TO FIG. 3C (CRADLE AT NORMAL UPRIGHT POSITION)

(CRADLE ROTATED 5° FROM NORMAL UPRIGHT POSITION)

(CRADLE AT NORMAL UPRIGHT POSITION)

(CRADLE ROTATED 30° FROM NORMAL UPRIGHT POSITION)

(CRADLE AT NORMAL UPRIGHT POSITION)

(CRADLE ROTATED 200° FROM NORMAL UPRIGHT POSITION)

(CRADLE AT NORMAL UPRIGHT POSITION)

(CRADLE ROTATED 160° FROM NORMAL UPRIGHT POSITION)

COMBINED SAND CORE MACHINE

BACKGROUND OF THE INVENTION:

This invention relates to an apparatus for producing rigid sand cores for use in metal casting. These rigid sand cores are produced from a molding mixture comprising a refractory granular material such as sand and a relatively small quantity of a hardenable binder.

Several different types of machines are presently available for producing rigid sand cores. These machines produce such rigid sand cores according to any one of a number of known processes. One of the primary differences between these known processes is the method used for setting or curing the molding mixture. The different curing methods are characterized by the different hardenable binders used in the molding mixture. Another difference between these known processes is determined by the desired form of the rigid sand core, that is, whether the sand core to be produced is solid or hollow. Hollow rigid sand cores are commonly known as shell sand cores.

Machines for producing shell sand cores for foundry purposes employ a molding mixture comprising sand mixed with a relatively small quantity of a thermo setting resin. The molding mixture is placed in a core or molding box of iron or other metal having internal contours corresponding with the internal contours of the article to be ultimately produced from the sand core. The core box is heated to a given temperature which is sufficient to cause a coating of the molding mixture to form and build up to a required thickness on the interior surface of the core box. This coating is partially set by the initial heat applied to the core box and the remaining molding mixture is then dumped from the core box by rotating the core box. The coating or shell formed by the molding mixture is then subjected to additional heat in order to complete the setting or curing process. The shell sand core is then removed from the core box and used as a mold for metal casting. Examples of this shell core process are shown and described in U.S. Pat. No. 3,511,302, issued to R. H. Barron on May 12, 1970, and U.S. Pat. No. 2,855,642, issued to G. W. Taylor on Oct. 14, 1958.

Another widely known method for producing rigid sand cores from a molding mixture of sand and a hardenable binder is known as the cold box process. In this process, the hardenable binder is a cold setting resin which reacts with a particular gas catalyst fed through to the core box to cure or set the molding mixture. Although many different gas mixtures may be employed as the catalyst, amine gas is often one of the primary constituents. After the molding mixture is hardened by the reaction with the cold setting catalyst, the gas catalyst is purged from the core box and the core is removed from the machine for use in metal casting. Examples of this cold box process are shown and described in U.S. Pat. No. 3,038,221, issued to F. Hansberg on June 12, 1962, and U.S. Pat. No. 3,702,316, issued to J. Robins on Nov. 7, 1972.

Many different modifications of these basic processes are known and used in the art. For example, solid sand cores also are formed by a process known as the hot box process which differs from the shell core process in that none of the molding mixture is dumped from the core box. Although the resins employed in the hot box process are usually different than the resins employed in the shell core process, the setting or curing of the molding mixture is accomplished by the application of heat to the core box. The core box is then removed from the machine and the solid sand core is utilized for metal casting. Various other processes, such as the warm box carbon dioxide process, are also known in the art.

Different machines are presently available in the art for producing rigid sand cores according to each one of the above known processes. Some of these known machines are capable of automatic operation. That is, one machine is known for automatically producing shell sand cores and another machine is known for producing cold box sand cores. Examples of such machines are the automatic shell core machine HS-16-RA, Redford Bulletin No. 704, and automatic cold box core machine CB-16-SA, Redford Bulletin No. 7201, produced by the Foundry Products Division of International Minerals and Chemical Corporation of Detroit, Michigan. In addition, some of these known machines have previously combined certain related sand core processes. For example, since the curing of the molding mixture in both the shell core process and the hot box process is accomplished by the application of heat, it is convenient to combine these two basic processes in the same machine. For example, automatic shell core machine HS-16-RA described above can also be used to automatically produce hot box sand cores. However, because of the many dissimilarities between the shell core process and the cold box process, no machine is presently known which can be conveniently programmed to automatically produce both cold box sand cores and shell sand cores.

Therefore, it is an object of this invention to provide a single machine for automatically producing both shell cores and cold box cores. This machine overcomes the practical difficulties previously encountered in combining such relatively different processes on the same machine. In addition, the combined sand core machine of the present invention is also capable of automatically producing hot box cores.

It is a further object of the present invention to provide an electric control circuit arrangement for automatically controlling the operation of the combined core machine during the hot box process, the cold box process or the shell core process. This circuit arrangement employs a unique combination of circuit elements, many of which perform different functions during each of the above different processes. Other circuit elements perform similar functions during each of the above different processes. In this manner, the number of circuit machine elements necessary for performing various functions in the above different processes is minimized and the operation of the machine is simplified. The control circuit arrangement is readily programmable for enabling the combined core machine to automatically produce sand cores according to each of the above processes.

SUMMARY OF THE INVENTION

The present invention is directed to a machine for producing rigid sand cores to be used in foundries for metal casting. These rigid sand cores are formed in a metal core or molding box which is placed in the combined core machine. A molding mixture of a refractory granular material such as sand and a hardenable binder is placed in a hopper mechanism. A sand magazine is positioned adjacent to the hopper mechanism for transporting the molding mixture from the hopper mechanism to the core box. The molding mixture is blown into the core box by a blow valve system which is controlled by an electrical control circuit comprising a plurality of switches and timers. This control circuit can be conveniently programmed to blow the correct amount of the molding mixture in the core box at the proper time and to refill the sand magazine with more molding mixture in preparation for the production of the next sand core. Selector switch means are provided in the control circuit for selecting any one of a plurality of modes of operation for the combined core machine. By setting the selector switch, the control circuit is set for automatic production of one of at least three different types of sand cores including shell cores, cold box cores, or hot box cores. Heating means controlled by the control circuit are utilized during the shell core process and the hot box process for curing the molding mixture which is placed in the core box. In addition, during the shell core process, the control circuit controls a cradle assembly combined with an automatic rollover mechanism which enables the combined core machine to dump the excess quantity of molding mixture from the core box. A shell sand return system is also employed during the shell core process for returning the dumped molding mixture to the hopper mechanism. This shell sand return system is also automatically controlled by the control circuit. If the selector switch means is set for operation of the core machine in the cold box mode, the control circuit automatically controls the introduction of a gas catalyst into the core box which is used for setting or curing the molding mixture. Also, the control circuit automatically controls the purging of the gas catalyst from the core box after the molding mixture is set or cured. At the same time, the control circuit enables the core machine to reload the hopper mechanism in preparation for the next automatic cycle. Many of the same switches and timers in the control circuit are capable of being reprogrammed for use during each of the different processes performed on the combined core machine.

According to the present invention, several parts of the combined core machine and the control circuit are utilized to perform the same function in each of the different processes. The clamping of the core box in the combined core machine by a horizontal clamping system is performed in the same manner during each of the modes of operation. The hopper mechanism, the sand magazine for transporting the molding mixture to the core box and the blow valve system for blowing the molding mixture into the core box are used and controlled in the same manner in all processes. The control circuit can be readily programmed to adjust the core machine for operation in each of these processes.

Further, according to the present invention, several elements of the control circuit are utilized to perform different functions in each of the different processes. For example, timing means used during the shell process to control the wall thickness of the shell core, the dumping of excess molding mixture and the curing of the remaining shell core are used during the cold box process to control the curing of the molding mixture with a gas catalyst, the purging of the gas catalyst from the core box and the reloading of the sand magazine for the next automatic cycle. As a result of these and other multiple functions performed by elements in the control circuit, the control circuit uses an economical number of parts and the programming of the combined core machine for different processes is greatly simplified.

DETAILED DESCRIPTION OF THE PREFERRED EMBODIMENT

Figure 1A:
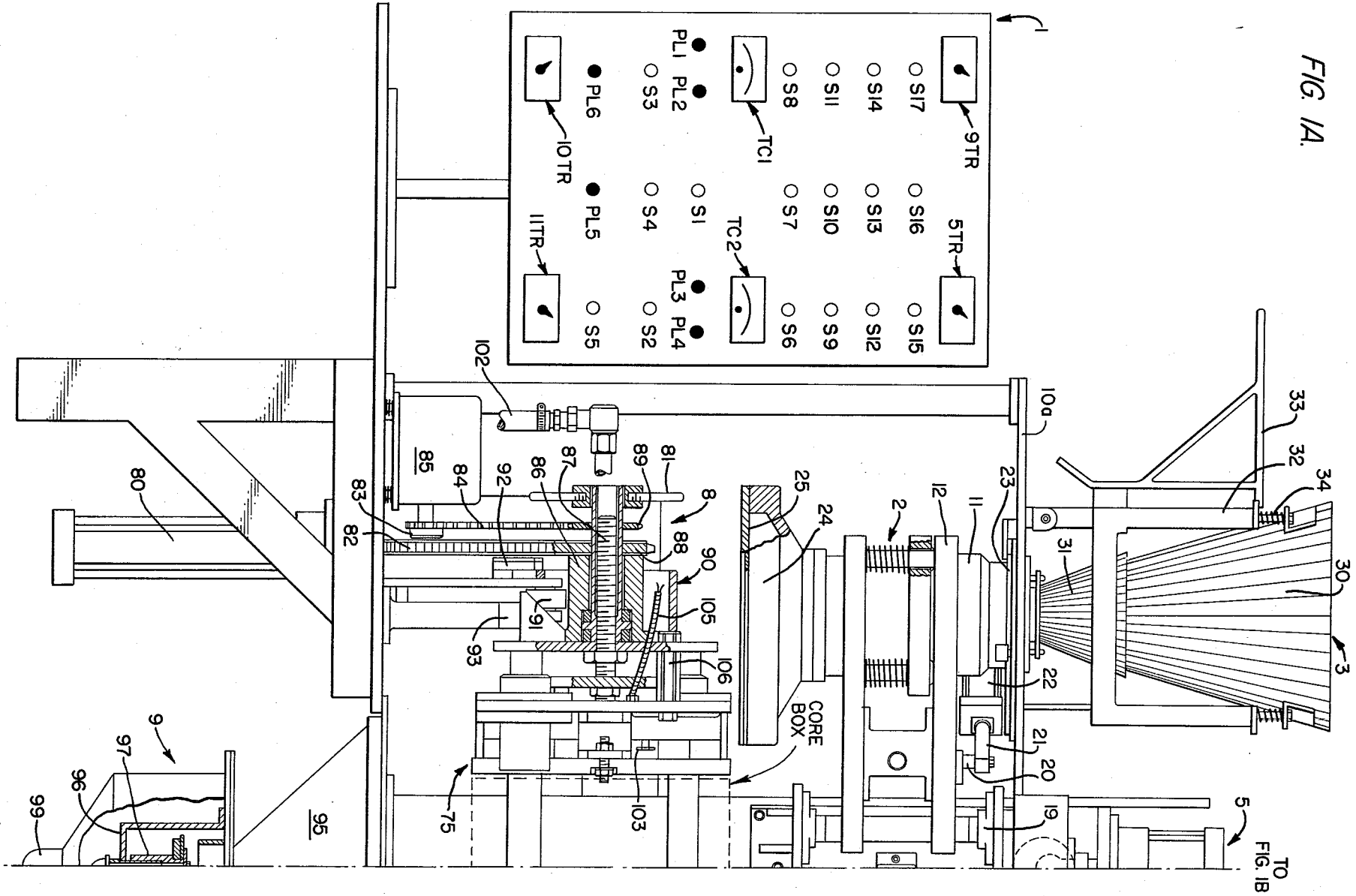
FIGS. 1A and 1B show is a front view of the apparatus comprising the present invention, including cross sectional views of related parts.
Figure 1B:
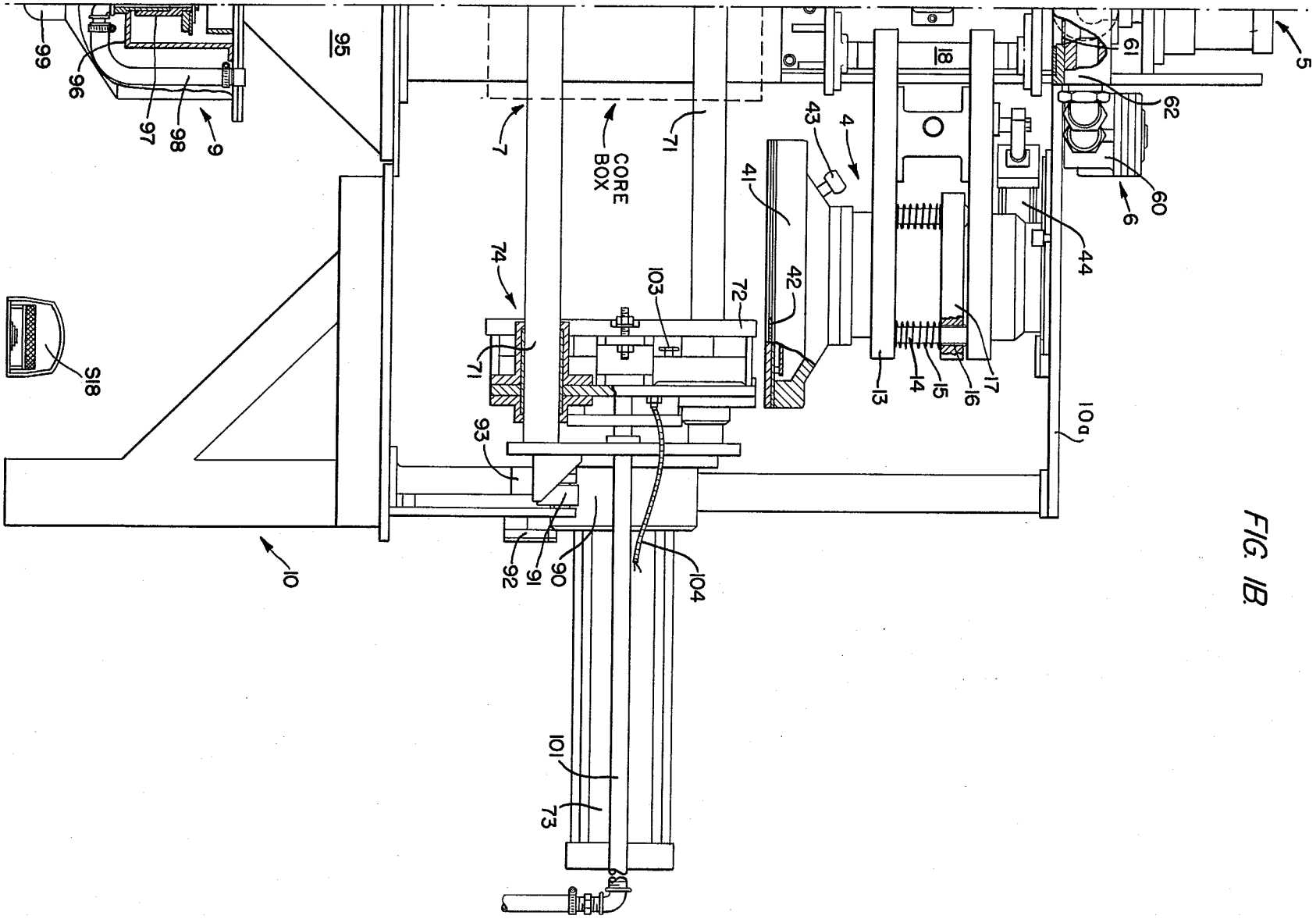

The combined core machine of the present invention is shown in FIGS. 1A and 1B. This machine includes a control box 1 which can be programmed to automatically control the combined core machine during the production of any one of several types of rigid sand cores including shell sand cores, hot box cores, or cold box cores. This control box 1 comprises numerous switches and pushbuttons, S1–S17, pilot lights PL1-PL6, temperature controllers TC1 and TC2, and programmable timers 5TR, 9TR, 10TR and 11TR. These elements, which are positioned on the control box 1 for ready access by the machine operator, are used for programming the combined core machine. These circuit elements as well as other internal circuit elements are shown in FIGS. 3A–3D and described below.

A molding mixture of a refractory granular material such as sand and a hardenable sand binder is placed in sand hopper mechanism 3 prior to the operation of the core machine. The composition of this molding mixture varies according to the type of sand core to be produced by the core machine, that is shell sand cores, hot box cores, or cold box cores. Different hardenable binders are utilized to produce each of these different rigid sand cores. In addition, since sand exhibits different physical properties, different types of sand can be used in the molding mixture in each of these different processes. The molding mixtures used for the cold box process generally contain a sand mixed with a cold setting resin which is cured by a reaction with a particular gas mixture such as T.E.A. (triethylamine) or D.M.E.A. (dimethylethylamine). The molding mixtures used for producing shell cores generally comprise a mixture of sand ranging from 45 to 160 fineness (standards developed by the American Foundrymen's Society) with a thermo setting phenol resin which is cured by the application of heat. Molding mixtures for both these processes and the hot box process are well known.

The sand hopper mechanism 3 in FIG. 1A includes a primary sand hopper 30 and a secondary sand hopper 31. The primary sand hopper 30 is mounted on hopper springs 34 which are supported by the hopper frame 32. By positioning the primary sand hopper 30 on hopper springs 34, the primary sand hopper 30 may be vibrated to force the sand contained therein to the bottom of the sand hopper mechanism 3 and into the sand magazine assembly 2. The primary sand hopper 30 is vibrated by a hopper vibrator connected thereto which is controlled by the pneumatic circuit shown in FIG. 2B and described below. The pneumatic circuit is controlled by the control circuit contained in control box 1 and shown in FIGS. 3A–3D which is also described below. A hopper handle 33 is also shown in FIG. 1A connected to hopper frame 32.

Figure 2A:
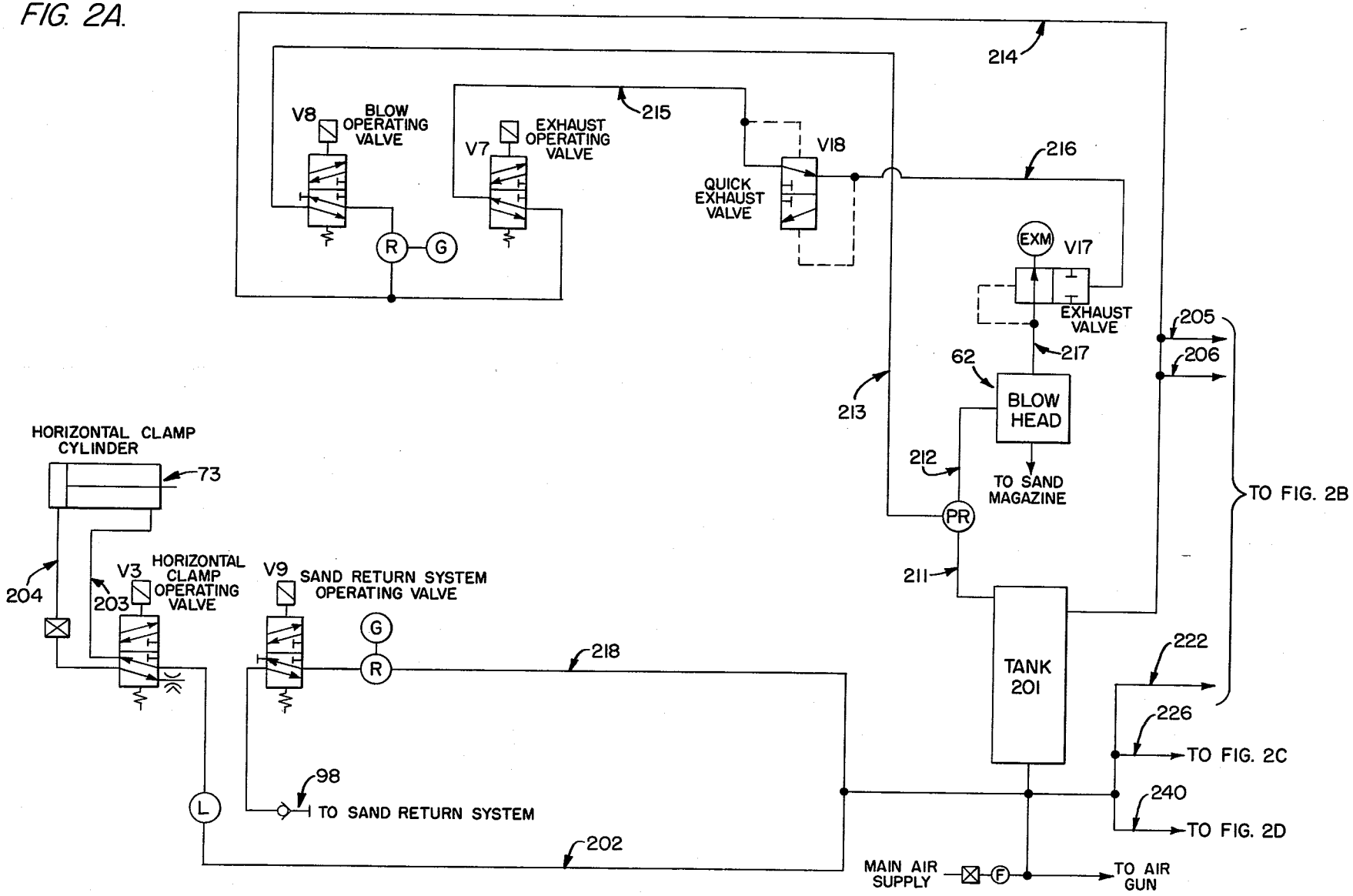
FIGS. 2A, B, C and D show the pneumatic circuit for controlling the apparatus shown in FIG. 1.
Figure 2B:
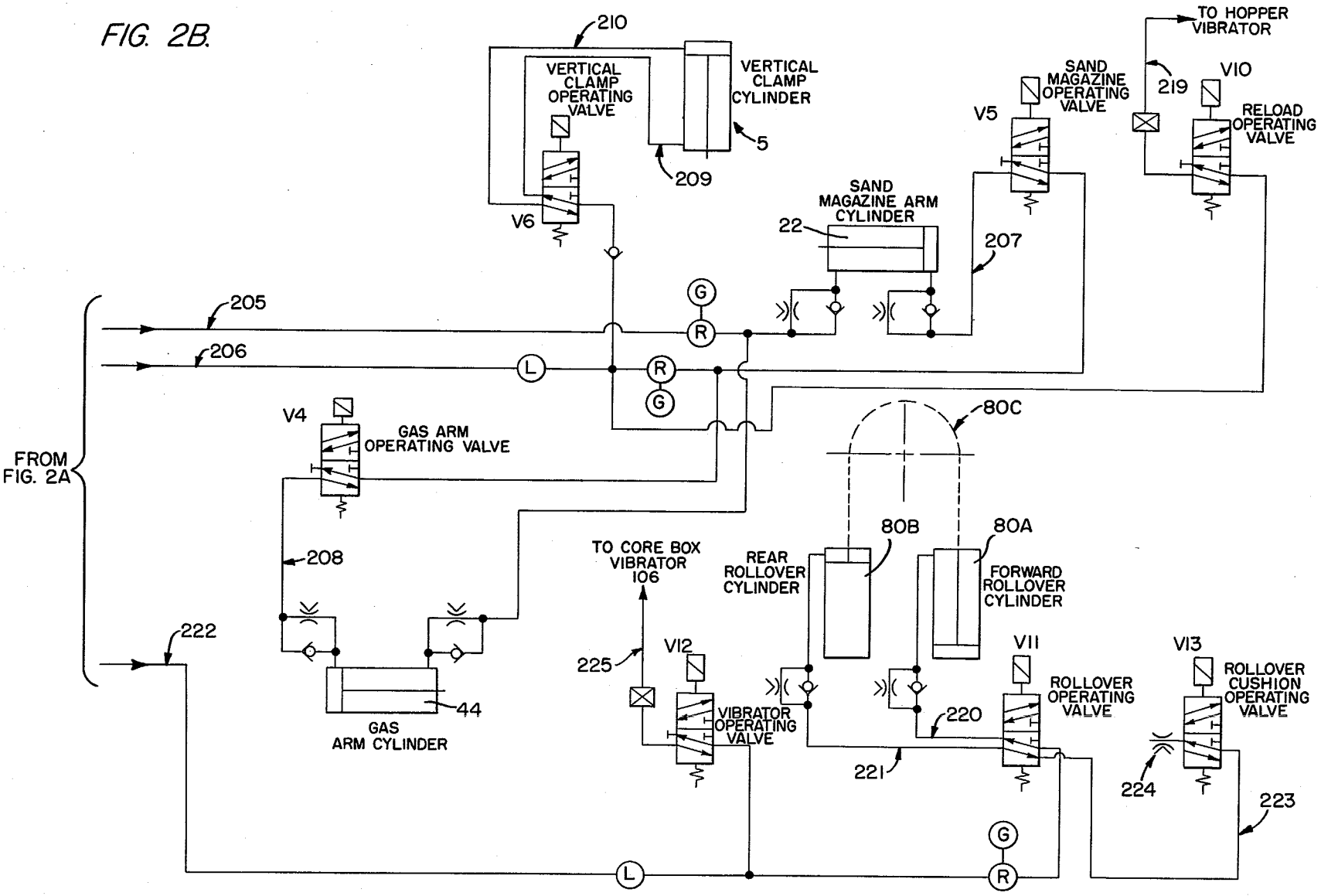

Positioned directly beneath sand hopper mechanism 3 in FIG. 1A is the sand magazine assembly 2. Sand magazine assembly 2 includes a shutter plate 23 which permits the sand molding mixture contained in sand hopper mechanism 3 to pass to the sand magazine assembly 2. The molding mixture is held by the sand magazine tube 11 which is connected to sand magazine head 24. The sand magazine tube 11 is supported by an upper magazine arm 12 and a lower magazine arm 13. The upper arm 12 is separated from the lower arm 13 by four magazine arm collar shafts 14 which further support the magazine guide ring 17. A guide ring bushing 16 separates the magazine guide ring 17 from the magazine arm collar shaft 14. A guide ring spring 15 is positioned around each of the magazine arm collar shafts 14 between the magazine guide ring 17 and the lower magazine arm 13. Since the sand magazine tube 11 is connected directly to magazine guide ring 17 which is supported by guide ring springs 15, the sand magazine tube 11 and the sand magazine head 24 can be moved slightly in a vertical direction upon application of a sufficient force to compress guide ring springs 15. The parallel magazine arms 12 and 13 are supported at one end by magazine arm main shaft 18 which is connected to the frame 10 of the core machine by bracket 19. The attachment of the upper and lower magazine arms 12 and 13 to the magazine arm main shaft 18 permits the sand magazine assembly 2 to move in a horizontal direction from beneath the sand hopper assembly 3 to a position directly above the core or molding box which is placed between cradle assemblies 74 and 75 in FIGS. 1A and 1B. The sand magazine assembly 2 is positioned over the core or molding box by the actuation of magazine arm cylinder 22 which is pneumatically controlled as shown in FIG. 2B and described below. The control circuit contained in control box 1 and shown in FIGS. 3A–3D controls the operation of the pneumatic circuit. The magazine arm cylinder 22 is connected by magazine arm eye 21 and magazine arm clevis 20 to the upper magazine arm 12. The body of the magazine arm cylinder 22 is rigidly supported by the horizontal support plate **10*a* of the frame 10. The sand magazine assembly 2 further contains sand magazine blow plate 25 for retaining the molding mixture in magazine tube 11**.

The gas magazine assembly 4 shown in FIG. 1B adjacent to the sand magazine assembly 2 is substantially identical to sand magazine assembly 2. However, in addition to magazine tube 11, upper magazine arm 12, lower magazine arm 13, collar shafts 14, guide ring 17, guide ring bushing 16, guide ring spring 15, magazine shaft 18, arm bracket 19, magazine arm clevis 20 and magazine arm eye 21, the gas magazine assembly contains a gas head 41 which blocks the magazine tube 11 from the gas head 41 and a gas plate 42. Gas is supplied through gas plate 42 by gas line 43 connected directly to gas head 41. Similar to the operation of the sand magazine assembly 2, the gas magazine assembly 4 may be positioned directly above the core or molding box which is placed between cradle assemblies 74 and 75. The horizontal movement of the gas magazine assembly 4 is controlled by magazine arm cylinder 44 which is also part of the pneumatic circuit shown in FIG. 2B and described below. The body of the magazine arm cylinder 44 is rigidly supported by the horizontal support plate **10*a* of the frame 10. The operation of magazine cylinder 44** is controlled by the control circuit shown in FIGS. 3A–3D.

A vertical clamp assembly 5 is located above the sand magazine assembly 2 and the gas magazine assembly 4. The vertical clamp assembly 5 is pneumatically operated as shown in FIG. 2B and is controlled by the control circuit shown in FIGS. 3A–3D. This assembly is operative to force the blow head 62 against the sand magazine assembly 2 and to force the sand magazine tube 11 and head 24 downward by compressing magazine springs 15 when the sand magazine assembly 2 is positioned below the vertical clamp cylinder assembly 5 and above the core or molding box. Likewise, the vertical clamp assembly 5 is operative to force the magazine tube 11 of the gas magazine assembly 4 in a downward vertical direction when the gas magazine assembly 4 is positioned directly beneath the vertical clamp cylinder 5 and above the core or molding box. The force exerted by the vertical clamp assembly 5 on the magazine tubing 11 of either the gas magazine 4 or the sand magazine assembly 2 compresses the guide ring springs 15 and forces these assemblies against the top of the core or molding box.

The molding mixture contained in the magazine tube 11 of the sand magazine assembly 2 is deposited in the core or molding box when the sand magazine assembly 2 is positioned directly beneath the vertical clamp assembly 5. The molding mixture is deposited in the core box by the action of compressed air blown against and through the molding mixture which forces the molding mixture through appropriate blow holes in the sand magazine plate 25. In addition, the compressed air evenly distributes and firmly packs the molding mixture in the core box. Compressed air is forced through sand magazine assembly 2 by blow valve assembly 6. The blow valve assembly 6 includes a blow valve 60, a blow head 62 and a blow head exhaust element 61. The blow valve 60 is pneumatically operated by the pneumatic circuit shown in FIG. 2A and described below. The operation of the blow valve 60 is automatically controlled by the control circuit shown in FIGS. 3A–3D and contained in control box 1 of FIG. 1A.

The core or molding box of the present invention is positioned between the left cradle assembly 75 and the right cradle assembly 74 of the cradle assembly 7. Each of these cradle assemblies includes a cradle plate 72 which is in direct contact with the core or molding box. Cradle guide rods 71 support the cradle assemblies 74 and 75. Cradle assembly 74 is movable in an inward horizontal direction along cradle guide rods 71 for the purpose of clamping the core or molding box between the cradle assemblies 74 and 75. The movement of the cradle assembly 74 is controlled by the horizontal clamp cylinder 73 which is pneumatically operated as shown in FIG. 2A and described below. The horizontal clamp cylinder 73 is automatically controlled by the control circuit shown in FIGS. 3A–3D.

The cradle assembly 7 is connected to the frame 10 in such a manner that the entire cradle assembly 7 including the core box may be rotated into an upside down position during the shell core process. This rollover of the cradle assembly 7 removes the excess molding mixture from the core box during the shell core process. In order for the cradle assembly 7 to rotate into the upside down position, an automatic rollover mechanism 8 is attached to the cradle assembly 7. Cradle drum 90 supports the cradle assembly and enables the cradle assembly 7 to rotate. The cradle assembly 7 rotates by the action of rollover chain 82 upon rollover sprocket 88 which is connected to sprocket adapter 86 contained within rollover drum 90. The action of the rollover chain 82 upon the rollover sprocket 88 is initiated by dual rollover cylinders 80 which are controlled pneumatically as shown in FIG. 2B. The pneumatic operation of the rollover cylinders 80 is further controlled by the control circuit contained in control box 1 and shown in FIGS. 3A–3D. Cradle rollover brackets 91 on both ends of the cradle assembly support the cradle assembly by supporting the cradle drums 90. The rollover action of the cradle assembly 7 is guided by cradle block assembly 92 connected to both ends of the cradle assembly. In addition, cradle stop cushions 93 are provided on both ends of the cradle assembly for preventing excessive cradle assembly rotation. A cradle spindle handle 81 is also provided for aligning the core or molding box parting face with the centerline of the machine.

A cam limit switch mechanism 85 is provided for sensing the relative position of the cradle assembly 7 during the rollover movement. The cam switch mechanism 85 contains a plurality of electrical switches connected in the control circuit shown in FIGS. 3A–3D. These switches are actuated by the cam elements shown in FIGS. 4–8. A cam switch chain 84 is connected to cradle cam sprocket 89 which is attached to the sprocket adapter 86 of the rollover mechanism 8. The other end of the cam switch chain 84 is connected to cam switch sprocket 83. The rollover movement of the cradle assembly 7 causes the cam switch chain 84 to rotate the cam switch sprocket 83 and actuate the electrical switches contained in the cam switch mechanism 85. The operation of the cam switch mechanism 85 will be described below in connection with the electrical control circuit in FIGS. 3A–3D and the cam switch mechanism further illustrated in FIGS. 4–8.

The combined core machine shown in FIGS. 1A and 1B further includes a sand return system 9 for returning the excess molding mixture dumped from the core box by the rollover mechanism 8 during the shell core process. The sand return system 9 includes a sand tray 95 for collecting the dumped molding mixture. A plunger bracket 96 supports a pressure stem 97 which is movable in an upward vertical direction to block the opening in the sand tray 95. The pressure stem 97 is actuated by the air pressure in pressure hose 98. A sand return system operating valve V9 shown in FIG. 2A and described below enables the sand return system 9 to return the molding mixture collected in sand tray 95 through sand return hose 99 to the sand hopper mechanism 3 by connecting the pressure hose 98 to a source of compressed air. The compressed air in pressure hose 98 forces the pressure stem 97 to close the opening in the sand tray 95 and the compressed air then forces the molding mixture through return hose 99 to the sand hopper mechanism 3. The operation of the sand return system operating valve is controlled automatically by the control circuit shown in FIGS. 3A–3D.

A gas heating system is shown in FIGS. 1A and 1B for use in curing the molding mixture during the shell core process and the hot box process. A gas hose 101 supplies gas to burner tips 103 in cradle assembly 74 and a gas hose 102 supplies gas to burner tips 103 in cradle assembly 75. The gas supply and burner system for the burner tips 103 is further illustrated in FIGS. 2C and 3A and described below. A thermocouple is connected to the cradle assembly 74 by thermocouple lead 104 and a second thermocouple is connected to cradle assembly 75 by thermocouple lead 105. These thermocouples enable the machine operator to control the temperature in the cradle assemblies 74 and 75 by adjusting the temperature controllers TC1 and TC2 located on the control box 1 and further shown in FIG. 3A.

Also shown in FIG. 1A is a vibrator mechanism 106 for vibrating the core or molding box upon completion of the core making process. This vibrator mechanism assists the machine operator in removing the core upon completion of the core making process. The vibrator 106 is controlled by foot switch S18 shown in FIG. 1B. In addition, the vibrator mechanism 106 can also be automatically operated by the control circuit shown in FIGS. 3A–3D during the rollover of the cradle assembly 7. This ensures that the excess molding mixture contained in the core or molding box during the operation of the rollover mechanism 8 is removed from the core or molding box and deposited in the sand return system 9.

FIGS. 2A–D show the pneumatic circuit for the combined core machine illustrated in FIG. 1. This pneumatic circuit comprises a plurality of electrically controlled operating valves connected to a plurality of pneumatic cylinders which operate the machine elements shown in FIG. 1. The operating valves function as pneumatic switches which control the pneumatic circuit. Air is supplied to the pneumatic circuit by the main air supply through a filter F. A compressed air tank 201 which is connected to the main air supply stores compressed air for supply to the pneumatic circuit.

The horizontal clamp cylinder 73 shown in FIG. 2A is connected to the main air supply over air line 202 through horizontal clamp operating valve V3. The horizontal clamp operating valve V3 is electrically controlled by the control circuit shown in FIGS. 3A–3D and described below. The pneumatic operation of the horizontal clamp cylinder 73 enables the cradle assembly 7 to clamp the core or molding box between the cradle assemblies 74 and 75 as shown in FIGS. 1A and 1B. A lubricator L is shown connected in line 202 between the main air supply and the horizontal clamp operating valve V3 for lubricating the various pneumatic circuit elements in a known manner. In the position shown in FIG. 2A, the horizontal clamp operating valve V3 connects the main air supply to the horizontal clamp cylinder 73 over line 203 to force the horizontal clamp cylinder 73 in the position shown. Upon electrical actuation of the horizontal clamp operating valve V3, the horizontal clamp operating valve V3 shifts to its second position in which the main air supply is connected to the horizontal clamp cylinder 73 through line 204 which enables the horizontal clamp cylinder 73 to move in the opposite direction. Thus, by alternately connecting lines 203 and 204 to the air line 202, the horizontal clamp operating valve V3 controls the direction of movement of the horizontal clamp cylinder 73.

The sand magazine arm cylinder 22 and the gas arm cylinder 44 shown in FIG. 2B are connected to the compressed air tank 201 over air line 205. A pressure regulator R and a pressure gauge G are connected between these magazine arm cylinders and the compressed air tank 201 for regulating the pressure in line 205. Other pressure regulators and pressure gauges are shown throughout the pneumatic circuit in FIGS. 2A–2D. The sand magazine arm cylinder 22 is further connected over line 207 to the sand magazine arm operating valve V5. In the position shown in FIG. 2B, the sand magazine arm operating valve V5 places line 207 in an open position. Line 206 also connects the compressed air tank 201 to the sand magazine arm operating valve V5. In the position shown in FIG. 2B, line 206 is blocked by the operating valve V5. As a result, the sand magazine arm cylinder 22 is placed in the position shown in FIG. 2B. Upon actuation of the sand magazine arm operating valve V5 by the electrical circuit shown in FIGS. 3A–3D, the sand magazine arm operating valve V5 shifts to a second position in which the air line 206 is connected to air line 207. In this position, because the air pressure in air line 206 is set higher than the air pressure supplied by the pressure regulator in air line 205, the sand magazine arm cylinder 22 is forced to move in the opposite direction. As the sand magazine arm cylinder 22 moves, the sand magazine assembly 2 shown in FIG. 1A moves over the core or molding box placed between the cradle assemblies 74 and 75. When the sand magazine arm operating valve V5 deactivates, the sand magazine arm cylinder 22 returns to its original position as shown in FIG. 2B.

The gas arm cylinder 44 shown in FIG. 2B and the gas arm operating valve V4 are connected in parallel with the sand magazine arm cylinder 22 and the sand magazine arm operating valve V5. Air line 208 connects the gas arm operating valve V4 to the gas arm cylinder 44 in the same manner as the air line 207 connects the sand magazine operating valve V5 to the sand magazine arm cylinder 22. The operation of the gas magazine arm assembly 4 in FIG. 1B is identical to the operation of the sand magazine arm assembly 2 described above. The gas arm operating valve V4 likewise is controlled by the control circuit shown in FIGS. 3A–3D.

The vertical clamp cylinder assembly 5 is shown in FIG. 2B connected to the compressed air tank 201 over air line 206. In the position shown in FIG. 2B, a vertical clamp operating valve V6 connects the vertical clamp cylinder 5 to air line 206 over air line 209. As a result, the vertical clamp cylinder 5 is forced by the compressed air in air line 209 in the position shown in FIG. 2B. The vertical clamp operating valve V6, which is controlled by the control circuit shown in FIGS. 3A–3D, disconnects line 209 upon actuation and connects air line 210 to the compressed air line 206 which shifts the vertical clamp cylinder 5 to a second position. In this latter position, the blow head 62 shown in FIGS. 1A and 1B moves in a downward vertical direction and engages one of either the sand magazine assembly 2 or the gas magazine assembly 4. In addition, the force exerted by the vertical clamp cylinder 5 also forces one of either the sand magazine assembly 2 or the gas magazine assembly 4 against the core box placed between the cradle assemblies 74 and 75.

The blow valve system 6 shown in FIGS. 1A and 1B comprises a blow head 62 shown also in FIG. 2A which is used to blow the molding mixture from the sand magazine assembly 2 into the core or molding box. Compressed air from tank 201 is fed through air line 211, pilot regulator PR and air line 212 to the blow head 62. The pilot regulator PR is controlled by the air pressure in control air line 213. In FIG. 2A, the pilot regulator PR is in a closed position because control air line 213 is depressurized. Thus, the pilot regulator PR prevents the passage of compressed air from the compressed air tank 201 to the blow head 62 while in this position. The air pressure in control line 213 is controlled by blow operating valve V8 which is controlled by the control circuit shown in FIGS. 3A–3D. Upon actuation of the blow operating valve V8 by the electrical control circuit, the blow operating valve V8 shifts to a second position in which the compressed air tank 201 is connected to the control air line 213 over air line 214. This enables the pilot regulator PR to switch to the open position. As a result, compressed air is fed from the compressed air tank 201 through air line 211, pilot regulator PR, air line 212, blow head 62, sand magazine assembly 2 to the core or molding box. When the blow operating valve V8 is returned to its normal position as shown in FIG. 2A, the pilot regulator PR again closes and prevents the passage of compressed air from the compressed air tank 201 to the blow head 62.

In addition to the blow system previously described, an exhaust system is also provided for exhausting the air pressure in the blow head 62 after completion of the blow process. An exhaust operating valve V7 shown in FIG. 2A controls the operation of the exhaust system. In the position shown, the exhuast operating valve V7 connects compressed air line 214 to an exhaust valve V17 through air line 215, quick exhaust valve V18, and air line 216. The exhaust valve V17 is connected to the blow head 62 over air line 217. As a result, when the exhaust operating valve V7 is in the position shown, the exhaust valve V17 is forced to the blocked position. The blocking of the exhaust valve V17 enables the blow head 62 to pass compressed air to the sand magazine assembly 2 when the pilot regulator PR is in the open position. Actuation of the exhaust operating valve V7 by the control circuit in FIGS. 3A–3D disconnects the air line 215 from the air line 214. The quick exhaust valve V18 then shifts to its second position which disconnects the air line 215 from the air line 216 and enables the compressed air in air line 216 to exhaust through the quick exhaust valve V18. The loss of compressed air in air line 216 causes the exhaust valve V17 to shift to the position shown in FIG. 2A. In this latter position, the exhaust valve V17 connects the air line 217 leading to the blow head 62 to the exhaust muffler EXM. The compressed air in blow head 62 then passes through air line 217 to atmosphere through exhaust muffler EXM.

Also shown in FIG. 2A is the sand return system operating valve V9 which controls the operation of the sand return system 9 shown in FIGS. 1A and 1B. The sand return system operating valve V9 is connected via air line 218 to the main air supply. In the position shown in FIG. 2A, sand return system operating valve V9 blocks air line 218. Upon actuation of the sand return system operating valve V9 by the control circuit, compressed air is passed through the sand return system operating valve V9 to air line 98 shown in both FIG. 2A and FIG. 1B. As previously described, the presence of compressed air in air line 98 forces the pressure stem 97 shown in FIGS. 1A and 1B in a vertical upward direction which blocks the opening between the sand return system 9 and the sand tray 95. In addition, the compressed air in air line 98 forces the molding mixture contained in the sand return system 9 through return line 99 back to the sand hopper assembly 3.

In FIG. 2B a mechanism is shown for vibrating the primary sand hopper 30 of the sand hopper assembly 3. This mechanism includes a reload operating valve V10 which is connected to air line 206. In the position shown in FIG. 2B, reload operating valve V10 blocks the passage of compressed air from air line 206. However, when reload operating valve V10 is shifted to its second position upon actuation by the control circuit shown in FIGS. 3A–3D, the air line 206 is connected to air line 219 which leads to the hopper vibrator. The hopper vibrator, which is activated by the compressed air in air line 219, vibrates the sand hopper 30 in the sand hopper assembly 3.

The automatic rollover mechanism 8 shown in FIGS. 1A and 1B is actuated by the dual rollover cylinders 80. As shown in FIG. 2B the dual rollover cylinders 80 comprise a forward rollover cylinder 80A and rear rollover cylinder 80B. These rollover cylinders are connected to each other by chain 80C. The operation of the dual rollover cylinders 80 is controlled by a rollover operating valve V11 which is controlled by the control circuit shown in FIGS. 3A–3D. The rollover operating valve V11 is only operated during the shell core process for the purpose of rotating the cradle assembly 7 in an inverted position which enables the core box to dump the excess molding mixture contained therein into the sand return system 9 shown in FIGS. 1A and 1B.

With the cradle assembly 7 in the normal upright position shown in FIGS. 1A and 1B, the rollover operating valve V11 and the rollover cylinders 80A and 80B are in the position shown in FIG. 2B. The rollover operating valve V11 is connected to the main air supply by air line 222. Air line 220 connects the rollover operating valve V11 to the forward rollover cylinder 80A and air line 221 connects the rollover operating valve V11 to the rear rollover cylinder 80B. In its normal position, the rollover operating valve V11 connects the air line 222 to the air line 220 which forces the forward rollover cylinder 80A in the position shown in FIG. 2B. Actuation of the rollover operating valve by the control circuit connects the air line 222 to the rear rollover cylinder 80B through air line 221. The air pressure in line 221 forces the rear rollover cylinder 80B and the forward rollover cylinder 80A connected thereto to move away from the position shown in FIG. 2B to rotate the cradle assembly 7. When the cradle assembly 7 rotates to a position approximately 30° or less from its normal upright position, the rollover cushion operating valve V13 is actuated by the control circuit shown in FIGS. 3A–3D. An air line 223 connects the rollover cushion operating valve V13 to the rollover operating valve V11. Actuation of the rollover cushion operating valve V13 disconnects the air line 223 from an orifice 224 and places the air line 223 in an open position. When the cradle assembly 7 rotates to its extreme position, the cam switches shown in FIGS. 7 and 8 enable the control circuit shown in FIGS. 3A–3D to switch the rollover operating valve V11 back toward its normal position shown in FIG. 2B. As a result, air line 222 is again connected to air line 220 and the rollover cylinder 80 is forced in the opposite direction by the air pressure on the forward rollover cylinder 80A. The cam switches shown in FIGS. 7 and 8 and the control circuit shown in FIGS. 3A–3D cause the rollover operating valve V11 to periodically actuate which produces a rocking action in the dual rollover cylinders 80 and the cradle assembly 7. Upon completion of this rocking action, the dual rollover cylinders 80 return to their normal position as shown in FIG. 2B. However, before reaching normal position, the rollover cushion operating valve V13 returns to its normal position as shown in FIG. 2B. By connecting air line 221 to orifice 224, the rollover cushion operating valve slows down the discharge of compressed air located in rear rollover cylinder 80B. Thus, rollover cushion operating valve V13 cushions the return of the dual rollover cylinders 80 and the cradle assembly 7 to their normal upright position.

Also connected to air line 222 in FIG. 2B is vibrator operating valve V12. In the position shown, the air line leading to vibrator operating valve V12 from air line 222 is blocked. Actuation of the vibrator operating valve V12 by the control circuit shown in FIGS. 3A–3D connects the air line 222 to air line 225 which actuates the core box vibrator 106 shown in FIG. 1A. The vibrator operating valve V12 is used for two purposes. First, when the cradle assembly 7 is rotated to dump the excess molding mixture from the core box, the core box vibrator 106 is actuated to ensure that all of the excess molding mixture is dumped from the core box. Second, the vibrator operating valve V12 actuates the core box vibrator upon completion of the core making process in order to assist the removal of the core or mold from the core or molding box mounted on cradle assembly 7.

Figure 2C:
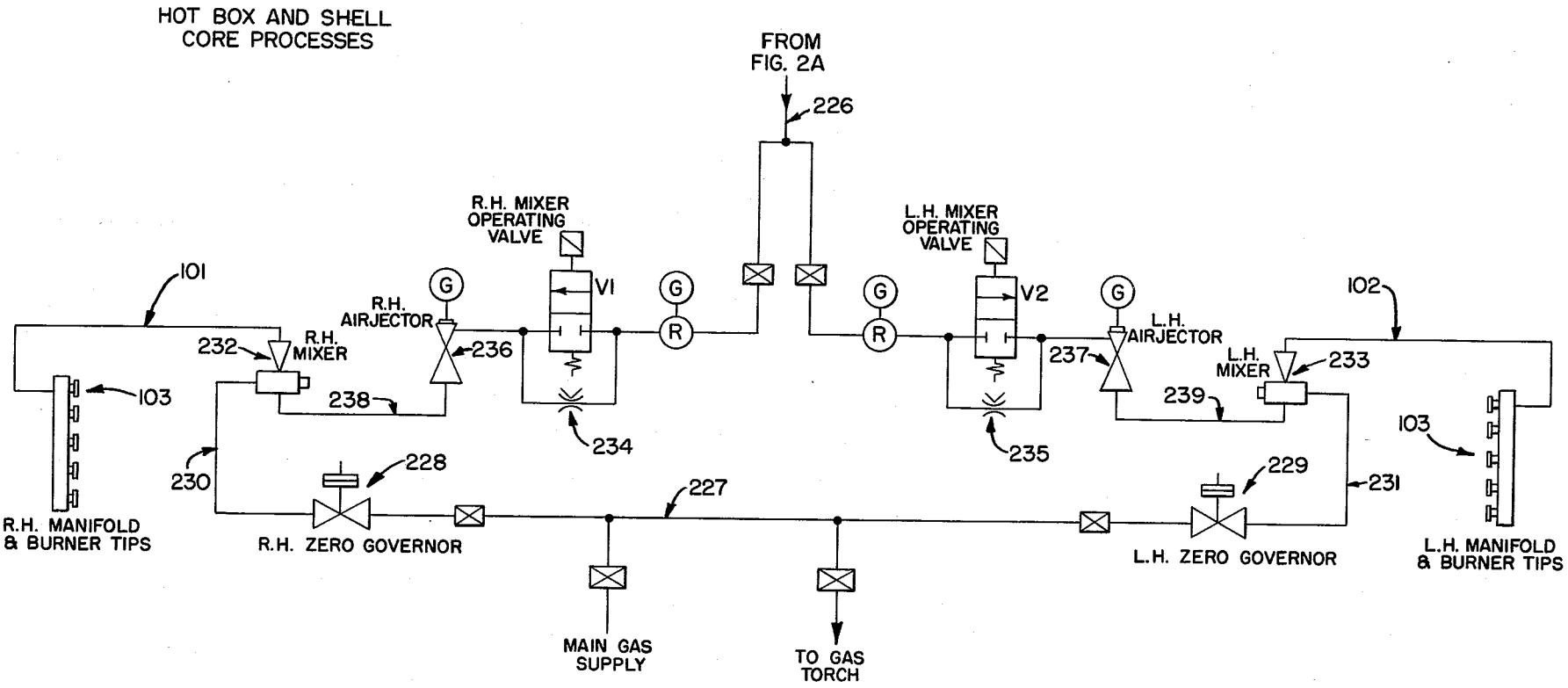

FIG. 2C shows the gas heating system for heating the core box during the shell core process and the hot box process. Air from the main air supply is fed to this gas heating system over air line 226. Independent heat control circuits are provided for the right hand manifold and burner tips 103 and the left hand manifold and burner tips. These burner tips 103 are manually ignited by the gas torch shown in FIG. 2C. A main gas supply supplies natural gas to gas line 227 which is connected to right zero governor 228 and left zero governor 229. These governors absorb irregularities in the gas pressure in gas line 227. Natural gas is fed through gas line 230 to right mixer 232 and through gas line 231 to left mixer 233. Compressed air and natural gas are mixed by these mixers and this mixture is fed to the manifolds and burner tips. These mixers, which are manually adjustable, are preset by the machine operator prior to the initiation of the core making process. Compressed air is fed to the right mixer 232 through right mixer operating valve V1, bypass orifice 234, right hand airjector 236 and air line 238. Similarly, compressed air is fed to the left mixer 233 through left operating valve V2, bypass orifice 235, left hand airjector 237 and air line 239. The bypass orifices 234 and 235 permit compressed air to flow to the mixers 232 and 233 at a low pressure when the mixer operating valves V1 and V2 are in their blocking positions. Actuation of either of the mixer operating valves V1 or V2 connects the compressed air line 226 through pressure regulators, to the mixers 232 and 233. The compressed air fed to the mixers 232 and 233 by the mixer operating valves V1 and V2 is at a higher pressure than the compressed air fed to the mixers by the bypass orifices 234 and 235. The mixers 232 and 233 automatically respond to the pressure level in air lines 238 and 239 by drawing in a higher proportion of natural gas at the high pressure level. Thus, the actuation of the mixer operating valves V1 and V2 by the control circuit creates a high fire condition in their respective mixers which increases the temperature at their respective manifolds and burner tips. As further described below in reference to FIGS. 3A–3D, the mixer operating valves V1 and V2 are responsive to the temperature of the core box. For example, when the temperature at the right hand side of the core box increases to a preset level, the mixer operating valve V1 switches to its normal position and the mixer 232 functions in response to the low pressure level generated by orifice 234.

Figure 2D:
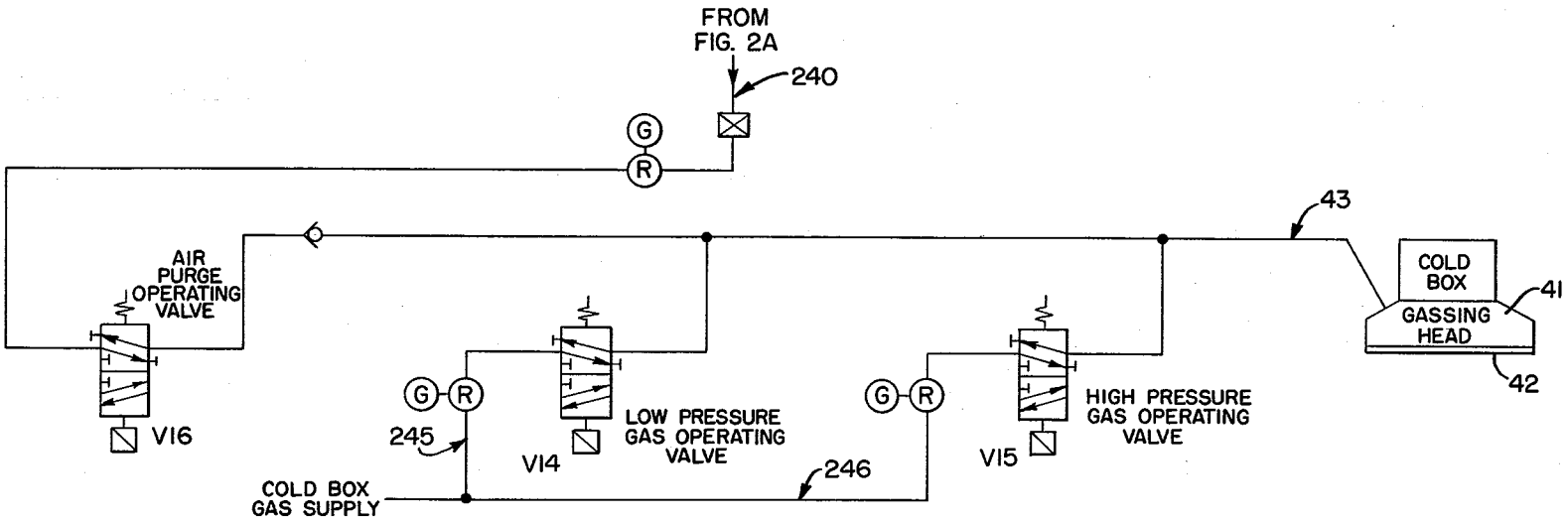

The gas supply system for the gas magazine assembly 4 is shown in FIG. 2D. This gas supply system, which is only used during the cold box process as a catalyst for curing the molding mixture, is automatically controlled by the control circuit in FIGS. 3A–3D. The gas is supplied by the cold box gas supply shown in FIG. 2D which supplies a mixture of carbon dioxide carrier gas or other carrier gas and other gases such as amine to gas lines 245 and 246. Gas line 245 is connected to a normally blocked low pressure gas operating valve V14 and gas line 246 is connected to a normally blocked high pressure gas operating valve V15. Actuation of each of these gas operating valves by the control circuit supplies gas from the cold box gas supply to gas line 43 which is connected to the cold box gas head 41. The gas then passes through gas plate 42 to the core or molding box and is utilized as a catalyst for curing the molding mixture contained in the core box. Upon completion of the curing process, the gas operating valves V14 and V15 are returned to their normal blocked position and the control circuit actuates air purge operating valve V16 connected between gas line 43 and air line 240 which is connected to the main air supply. The air from air line 240 is used to purge the catalyst gas from the gas head 41 and the core box. After the purging of the core box, the air purge operating valve returns to its normal position as shown in FIG. 2D and blocks the compressed air line 240.

The automatic control circuit for the combined core machine is shown in FIGS. 3A–3D. This circuit is designed to permit the machine operator to program the core machine for automatic operation in any one of three possible modes. The core machine may be programmed to automatically produce shell cores, hot box cores, or cold box cores by setting the selector switch S4 shown in FIG. 3A and manually programming the timers and control switches accordingly. In addition to programming these timers and switches, very little mechanical change is required to convert from one process such as the shell core process to another process such as the cold box process. Removal of the shell retainer plate 25 from the sand magazine assembly 2 and replacement of the hopper shutter plate 23 are the only other changes required.

Power is supplied to the control circuit in FIGS. 3A–3D by a 115 volt supply source connected to power lines 301 and 302 through fuses F1 and F2. The temperature control circuit, which is utilized only during the shell or hot box processes, is connected to power lines 301 and 302 by temperature control switch S1. As previously described with reference to FIG. 2C, the right hand manifold is controlled by right mixer valve V1 and the left hand manifold is controlled by left mixer operating valve V2. A temperature controller TC1 and thermocouple T1 control the operation of right mixer valve V1 while a temperature controller TC2 and thermocouple T2 control the operation of left mixer valve V2. The temperature controllers TC1 and TC2 are each set to achieve a desired temperature in the core or molding box. When the thermocouple T1 detects a temperature at the core or molding box within the temperature range set by temperature controller TC1, the temperature controller TC1 switch contacts actuate low fire pilot light PL1. When the temperature at the core or molding box is lower than the temperature range set by temperature controller TC1, the temperature controller TC1 switch contacts actuate high fire pilot light PL2 and right mixer valve V1. The operation of right mixer valve V1 enables the right mixer 232 shown in FIG. 2C to automatically draw in a higher proportion of natural gas which increases the temperature at the right manifold. As the temperature at the right manifold returns to the range set by right temperature controller TC1, the temperature controller TC1 switch contacts disconnect the right mixer valve V1 and pilot light PL2 and again actuates the low fire pilot light PL1. Similarly, temperature controller TC2 actuate pilot lights PL3, PL4 and left mixer valve V2 associated with left mixer 233 in FIG. 2C.

A power on/off pushbutton switch system connects power lines 301 and 302 to relay 1CR which connects these power lines to the control circuit over relay contacts 1CR-2 and 1CR-3. Relay contact 1CR-1 is a holding contact connected across the switch S3 for holding relay 1CR on after switch S3 is released. An emergency stop switch S2 is provided for disconnecting the power supply from the control circuit by disconnecting the power relay 1CR. A pilot light PL5 is also provided for indicating whether the power relay 1CR is activated and power is being supplied to the control circuit.

The selector switch S4 is a three position switch for selecting the mode of operation of the combined core machine. When the selector switch S4 is positioned in the shell position, relay 3CR is actuated. On the other hand, if it is desired to produce cold box cores, the selector switch S4 is positioned in the cold box position and relay 2CR is actuated. Finally, if the selector switch S4 is positioned in the hot box position, both the relays 2CR and 3CR remain off and the combined core machine is programmed to produce hot box cores. A plurality of relay contacts 2CR-1 through 2CR-8 are associated with relay 2CR and a plurality of relay contacts 3CR-1 through 3CR-8 are associated with relay 3CR. These various relay contacts control the operation of the control circuit during either the shell mode or the cold box mode as described below.

The automatic cycle for the combined core machine is initiated by a pair of interconnected start switches S5 and S6. Start switch contacts S5-2 and S6-2, which are normally closed, are connected through normally closed relay contact 4CR-1 to relay 5CR. Relay contact 5CR-1 is connected in series with start switch contacts S5-1 and S6-1 and relay contact 5CR-2 is connected in parallel with start switch contacts S5-2 and S6-2. When power lines 301 and 302 are connected to power lines 304 and 305 by relay 1CR, relay 5CR is immediately actuated through start switch contacts S5-2 and S6-2. In this manner, relay 5CR prevents initiation of the automatic cycle if one or both of the start switches S5 and S6 are actuated at the time the power switch S3 is actuated. For example, the automatic cycle cannot be initiated by taping down one or both of the start switches S5 and S6. By requiring the machine operator to simultaneously actuate both start switches S5 and S6 after the power switch S3 is turned on, each cycle of the combined core machine is started safely.

Another safety feature shown in FIG. 3A is dual push button timer 1TR which is connected in series with start switch contacts S5-1 and S6-1. In order to lock-in the automatic cycle, automatic cycle relay 4CR, which is connected in series with normally open timer contact 1TR-1, must be actuated. Since timer contact 1TR-1 remains in the open position until the expiration of the time period provided by timer 1TR, the automatic start switches S5 and S6 must be held down for a time period at least as long as the time period of timer 1TR. By locating the start switches S5 and S6 a sufficient distance from each other as indicated on the control box of FIG. 1A, the machine operator is required to use both hands for a given period of time to initiate the automatic start cycle. A holding contact 4CR-2 holds relay 4CR on throughout the automatic cycle. In addition, an automatic cycle pilot light PL6 is provided to indicate that the combined core machine is in the automatic cycle.

In addition to holding relay 4CR on during the automatic cycle, the closing of relay contact 4CR-2 provides continued actuation of horizontal clamp valve V3 which is initially activated by start switches S5 and S6. As described previously, this horizontal clamp valve V3 enables the horizontal cylinder 73 shown in FIG. 2A to clamp the core or molding box between the cradle assemblies 74 and 75 in FIG. 1. A horizontal clamp switch S7 is connected to horizontal clamp valve V3 for programming the horizontal clamp valve for either automatic or manual operation. During the automatic cycle, the horizontal clap switch S7 must be positioned in the automatic position in order for start switches S5 and S6 and relay contact 4CR-2 to actuate the horizontal clamp valve V3.

The closing of relay contact 4CR-2 also provides continuity of power to line 303 which is connected to sand magazine arm delay timer 2TR. When timer 2TR times out, timer contact 2TR-1 closes to connect sand magazine arm valve V5 to power lines 304 and 305 through cam switch CS1 and normally closed relay contact 6CR-2. As shown in FIG. 2B, the sand magazine arm valve V5 controls sand magazine arm cylinder 22 which moves the sand magazine assembly 2 in FIG. 1 over the core or molding box. The cam switch CS1, which is further described and shown in FIGS. 4 and 5, remains in the closed position as shown in FIG. 3B when the cradle assembly 7 in FIGS. 1A and 1B is in its normal upright position. Thus, the sand magazine arm assembly 2 is prevented from moving forward while the cradle assembly 7 is in any position other than its normal upright position. Manual switch S8 is connected to sand magazine arm valve V5 for placing the sand magazine arm valve V5 in either the automatic or manual mode. In order for the control circuit to automatically actuate the sand magazine arm valve V5, the manual switch S8 must be positioned in the automatic mode.

As the sand magazine assembly 2 in FIG. 1A swings forward, a limit switch LS2 positioned adjacent the sand magazine arm assembly 2 is closed to actuate the vertical clamp delay timer 3TR. Timer contact 3TR-1 is closed upon expiration of the time period provided by vertical clamp delay timer 3TR. The closing of timer contact 3TR-1 provides power to vertical clamp valve V6 from power line 303 through normally closed relay contact 6CR-3, vertical clamp switch S9, and normally closed relay contact 10CR-4. Vertical clamp switch S9 enables the machine operator to program the vertical clamp valve V6 for either automatic or manual operation. The actuation of the vertical clamp valve V6 actuates the vertical clamp cylinder 5 shown in FIGS. 1 and 2B. In addition to actuating vertical clamp valve V6, the closing of relay contact 3TR-1 actuates blow delay timer 4TR. Upon expiration of the time period provided by blow delay timer 4TR, timer contacts 4TR-1 and 4TR-2 are closed. Thus, blow delay timer 4TR allows time for the vertical clamp valve V6 to move the vertical clamp cylinder 5 prior to actuation of the blow timer motor 5TR connected to timer contact 4TR-1.

The blow timer motor 5TR and the blow timer clutch 5TC are actuated upon the closing of blow delay timer contact 4TR-1. The blow pilot valve V8 is actuated through timer contact 5TR-1, timer clutch contact 5TC-1 and blow valve switch S10. The blow valve switch S10 is an automatic/manual switch for the blow valve V8. Because timer contact 5TR-1 opens upon the expiration of the time period of the blow timer motor 5TR, the blow valve V8 is actuated for a time period corresponding to the time period of the blow timer motor 5TR. A second timer contact 5TR-2 ensures that the timer motor 5TR remains in the off position upon the expiration of the time period provided by blow timer motor 5TR. As described previously, the blow pilot valve V8 controls the operation of the blow head 62 shown in FIG. 2A.

Upon the expiration of the time period provided by blow timer motor 5TR, a third timer contact 5TR-3 closes to actuate an exhaust delay timer 6TR. Timer 6TR provides a short time delay between the end of the blow process controlled by blow pilot valve V8 and the start of the exhaust process controlled by exhaust pilot valve V7. Exhaust pilot valve V7 is connected to exhaust delay timer contact 6TR-1 which is closed upon expiration of the time period provided by exhaust delay timer 6TR and relay contact 4CR-3 which is closed because of the actuation of relay 4CR. In addition to actuating the exhaust pilot valve V7, the closing of timer contact 6TR-1 actuates the blow exhaust timer 7TR through relay contacts 4CR-5 and 6CR-7. Timer contacts 7TR-1 and 7TR-2 close upon expiration of the time period provided by blow exhaust timer 7TR. The closing of timer contact 7TR-1 actuates relay 6CR which opens relay contact 6CR-3 connected to vertical clamp valve V6 and relay contact 6CR-2 connected to sand magazine arm valve V5. As a result, the vertical clamp valve V6 enables the vertical clamp cylinder 5 to return to its normal upward position and the sand magazine arm valve V5 enables the sand magazine assembly 2 to return to its normal position. In addition, the blow exhaust timer 7TR is disconnected from line 303 by the opening of relay contact 6CR-7. A holding contact 6CR-4 holds relay 6CR on.

The remainder of the control circuit will now be described for the shell core process; that is, it is assumed the selector switch S4 is positioned in the shell mode. The hot box process and the cold box process will be described thereafter. Thus, the operation of relay contacts 6CR-1, 6CR-5 and 6CR-6 will be described below with respect to the cold box process.

Figure 3C:
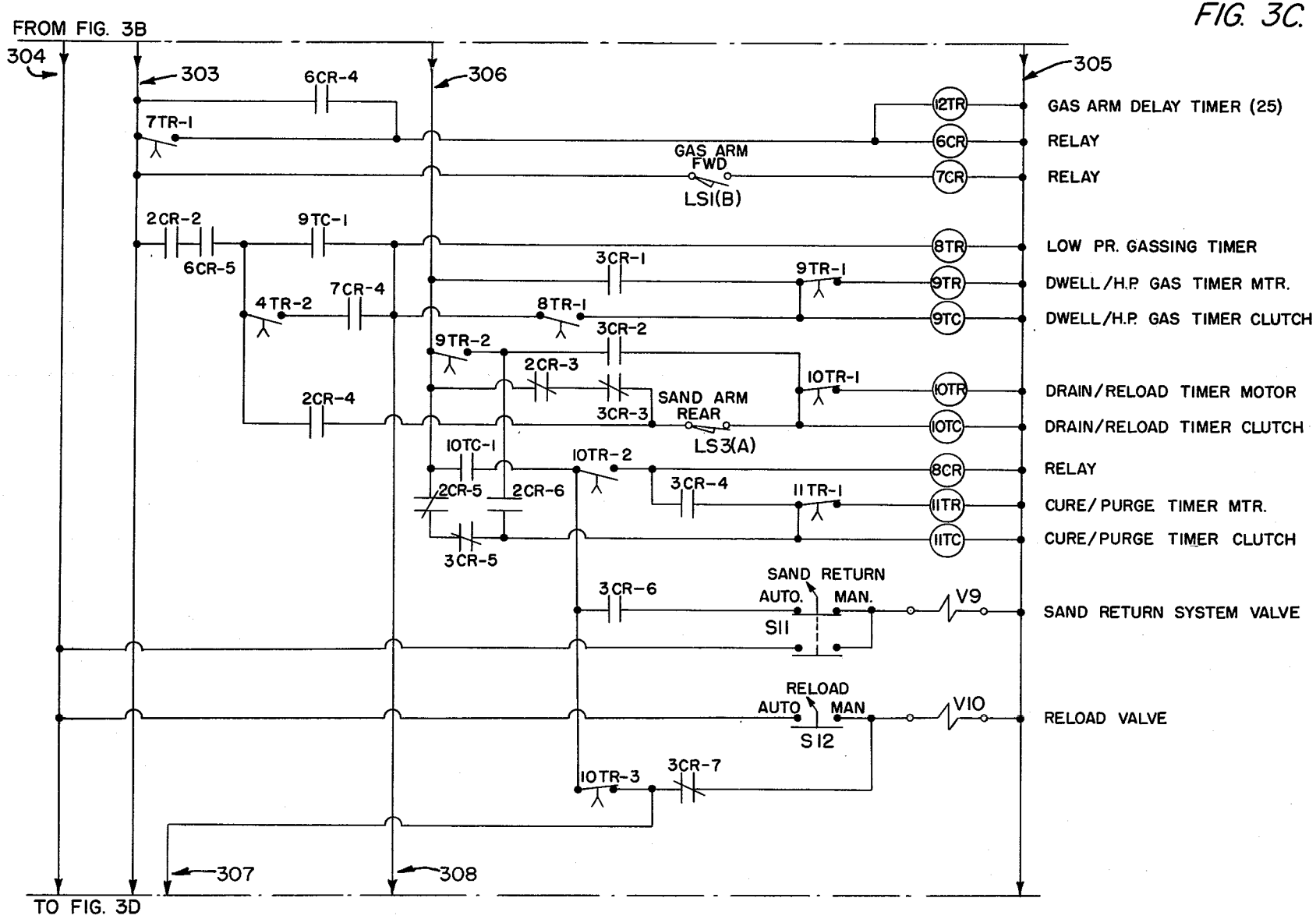
FIGS. 3A, B, C, and D show the electrical control circuit used to control the pneumatic circuit of FIG. 2.

The actuation of blow timer clutch 5TC closes timer clutch contact 5TC-2 to provide power to power line 306. As shown in FIG. 3C, power line 306 is connected to dwell timer motor 9TR and dwell timer clutch 9TC through shell mode relay contact 3CR-1. During the time period provided by the dwell timer 9TR, a thin coating or wall of molding mixture in the core or molding box begins to harden. Upon expiration of the time period provided by the dwell timer 9TR, timer contact 9TR-2 closes to actuate the drain timer motor 10TR and the drain timer clutch 10TC through now closed shell mode relay contact 3CR-2. Dwell timer motor contact 9TR-1 is connected directly to the dwell timer motor 9TR for automatically inactivating the dwell timer motor 9TR upon expiration of the time period provided by the dwell timer motor 9TR.

The time period provided by the drain timer motor 10TR is utilized during the shell process to control the rollover time period of the cradle assembly 7. Drain timer comtact 10TR-1 is connected to drain timer motor 10TR to automatically shut off the drain timer motor upon the expiration of the time period provided by the drain timer motor 10TR. A second drain timer motor contact 10TR-2 is connected to relay 8CR and cure time motor 11TR and cure timer clutch 11TC. The circuit controlled by timer contact 10TR-2 will be described below with respect to both the shell core process and the hot box process. A third timer contact 10TR-3 is normally closed and connects the power line 306 through timer clutch contact 10TC-1 to power line 307 which leads to the automatic rollover system shown in FIG. 3D. In addition to actuating the power line 307, the timer clutch contact 10TC-1 actuates the sand return system valve V9 through relay contact 3CR-6 and sand return switch S11. Sand return switch S11 controls the operation of the sand return system in either the automatic or manual mode.

Figure 3D:
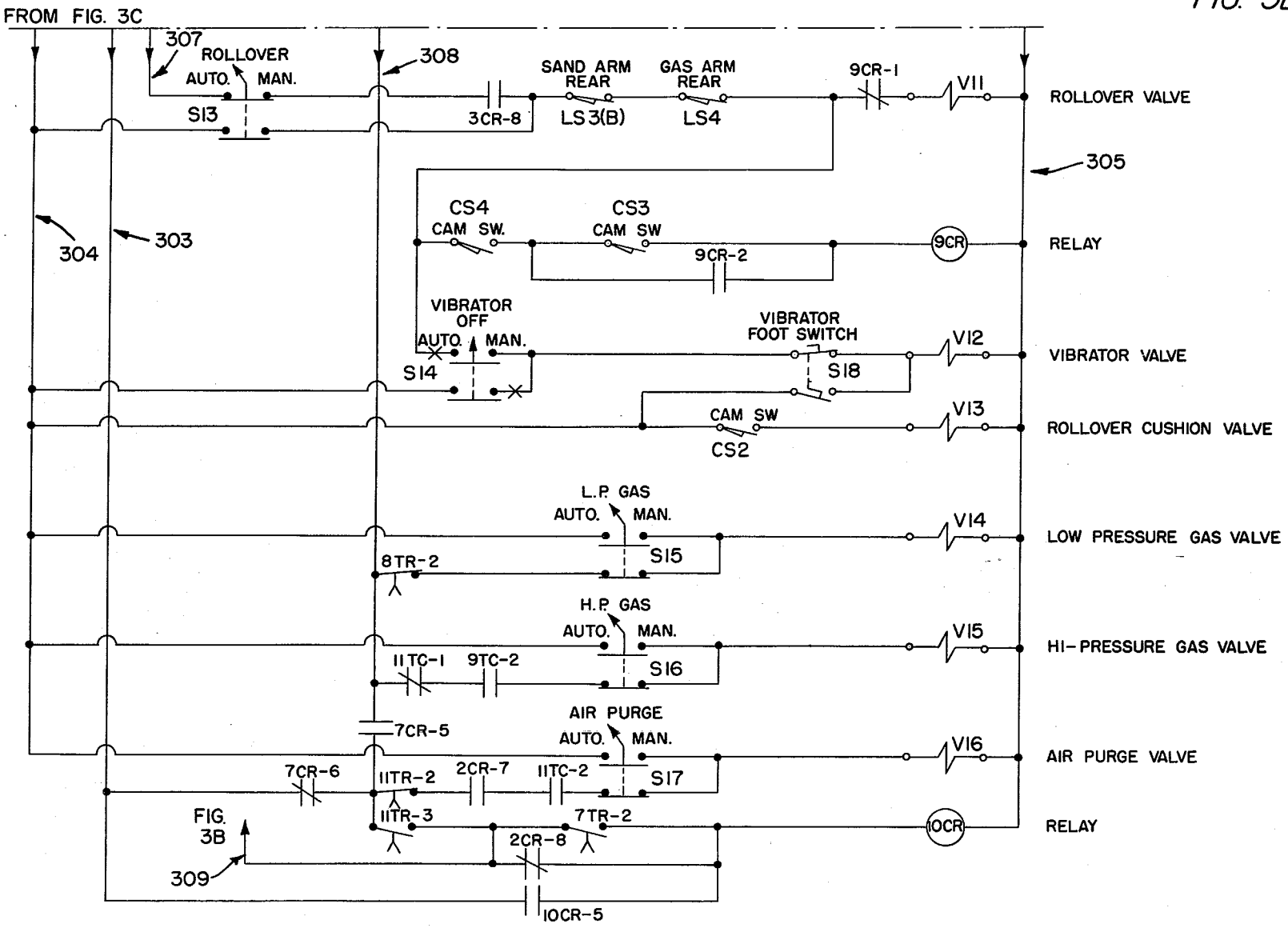

Upon the closing of drain timer clutch contact 10TC-1, power is fed through drain timer motor contact 10TR-3 to power line 307 which is connected to rollover valve V11 in FIG. 3D through rollover switch S13, shell mode relay contact 3CR-8, rear sand arm limit switch LS3B, rear gas arm limit switch LS4, and relay contact 9CR-1. The rollover valve V11 actuates the dual rollover cylinders 80 shown in FIGS. 1A and 2B. Rollover switch S13 is an automatic/manual control switch for the rollover valve V11. The limit switches LS3B and LS4, which are positioned adjacent the sand arm assembly 2 and the gas arm assembly 4 in FIGS. 1A and 1B, are closed when these assemblies are in their rear positions. This prevents the operation of the rollover valve V11 if either of these assemblies is in the forward position.

As described previously, the automatic rollover system includes a plurality of cam switches which enables the cradle assembly 7 to rock back and forth. In addition, a rollover cushion valve V13 is provided to control the stopping of the cradle assembly 7 as the cradle assembly 7 returns to its normal upright position. The rocking action of the cradle assembly 7 and the cushion effect of the rollover cushion valve V13 are controlled by the cam switches shown in FIG. 4.

Figure 4:
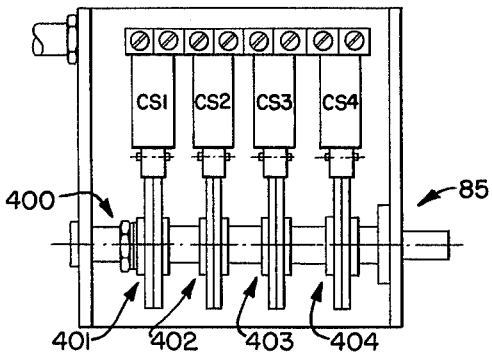
FIG. 4 is a cross sectional view of the cam limit switch shown in FIG. 1.

FIG. 4 is a cross sectional view of the cam switch mechanism 85 as shown in FIG. 1A. A plurality of cam mechanisms 401, 402, 403 and 404 are connected to cam shaft 400 for actuating cam switches CS1, CS2, CS3 and CS4. The cam shaft 400 shown in FIG. 4 is connected to the cam sprocket 83 shown in FIGS. 1A which is rotated by the interaction of cam chain 84 and cradle assembly 7. Thus, as the cradle assembly 7 rotates, the cam switches CS1–CS4 are actuated.

Figure 5A:
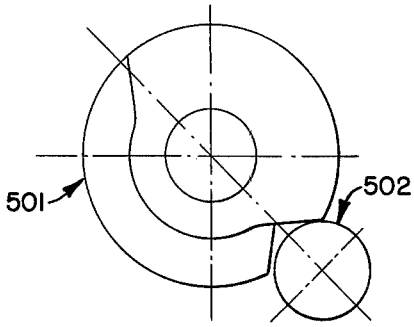
FIGS. 5A and B show the operating positions of cam elements 401 in FIG. 4.
Figure 5B:
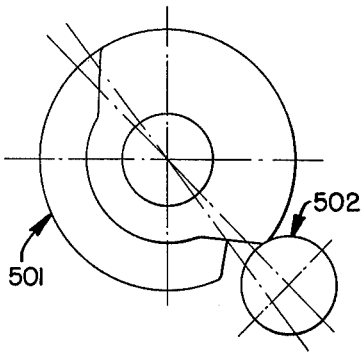

The cams of cam switch CS1 are shown in FIGS. 5A and 5B. The cams 501 and 502 are set so that cam switch CS1 is closed when the cradle assembly 7 is rotated five degrees or less from the normal upright position (FIG. 5A) and open when the cradle assembly 7 is rotated beyond five degrees (FIG. 5B).

Figure 6A:
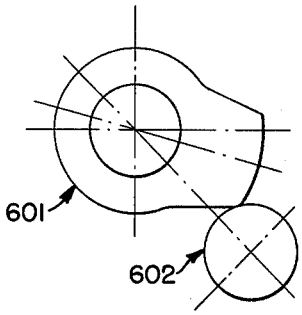
FIGS. 6A and B show the operating positions of the cam elements 402 in FIG. 4.
Figure 6B:
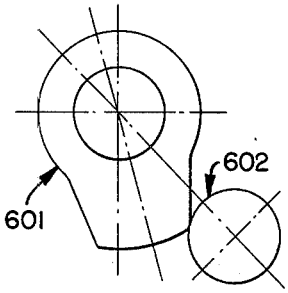

The cams of cam switch CS2 are shown in FIGS. 6A and 6B. This cam switch is utilized to turn off the cradle cushion valve V13 shown in FIG. 3D in order to slow the cradle assembly 7 as it returns to its normal upright position. As shown in FIGS. 6A and 6B, the cams of switch CS2 are set so that the switch CS2 is closed when the cradle is in its normal upright position, open when the cradle is rotated thirty degrees or less from its normal upright position, and closed when the cradle is rotated more than thirty degrees from its normal upright position. Thus, the cams 601 and 602 shown in FIGS. 6A and 6B open cam switch CS2 when the cradle assembly 7 is between its initial rollover position and a position thirty degrees from its normal upright position.

Figure 7A:
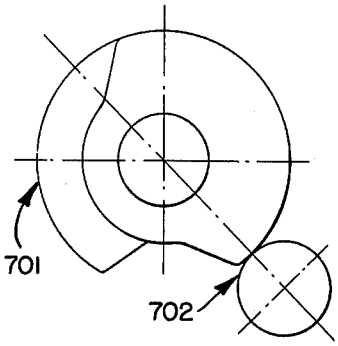
FIGS. 7A and B show the operating positions of the cam elements 403 in FIG. 4.
Figure 7B:
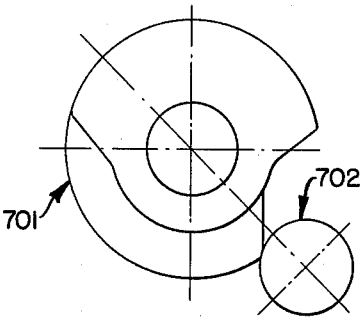

Cams 701 and 702 shown in FIGS. 7A and 7B control the action of cam switch CS3. The cams 701 and 702 are set so that cam switch CS3 is open when the cradle assembly 7 is rotated 200° or less from its normal upright position and closed when the cradle assembly 7 is rotated more than 200° from its normal upright position. Thus, as shown in FIG. 7B, the cams 701 and 702 enable the cam switch CS3 to close as the cradle assembly 7 is rotated greater than 200° from its normal upright position.

Figure 8A:
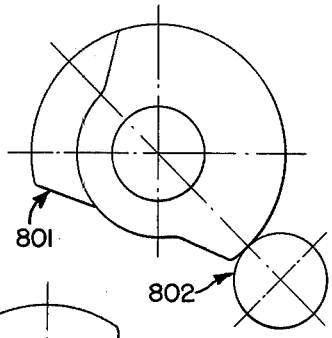
FIGS. 8A and B show the operating positions of the cam elements 404 in FIG. 4.
Figure 8B:
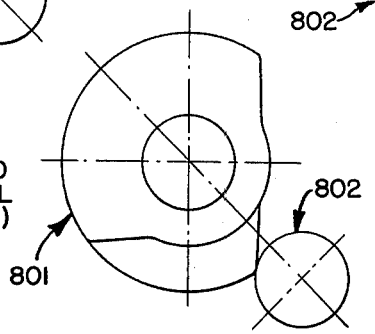

Cam switch CS4 as shown in FIGS. 8A and 8B is controlled by cams 801 and 802. Cams 801 and 802 are set so that cam switch CS4 is open when the cradle assembly 7 is rotated 160° or less from its normal upright position and closed when the cradle assembly 7 is rotated 160° or more from its normal upright position. Thus, as the cradle assembly 7 is rotated, cam switch CS4 is actuated to the closed position and then as the cradle assembly 7 reaches the 160° position.

As shown in FIG. 3D, the closing of cam switches CS3 and CS4 enables the control circuit to turn off the rollover valve V11 when the cradle assembly 7 approaches its extreme rollover position by actuating relay 9CR which opens relay contact 9CR-1 connected in series with rollover valve V11. When the rollover valve V11 is disconnected from the control circuit, the dual rollover cylinders 80 shown in FIG. 2B begin to return the cradle assembly 7 to its normal upright position. As the cradle assembly 7 begins to return, cam switch CS3 again opens. However, cam switch CS3 alone does not change the circuit operation since relay contact 9CR-2 forms a closed shunt across cam switch CS3. Relay 9CR remains actuated until the cradle assembly 7 is rotated sufficiently to open cam switch CS4 which opens when the cradle assembly 7 is rotated to within 160° of its normal upright position. The opening of cam switch CS4 disconnects relay 9CR from the control circuit and relay contact 9CR-1 closes to again actuate the rollover valve V11. A repeating rocking action occurs which is terminated by the expiration of the time period provided by drain timer motor 10TR. Drain timer motor 10TR then opens drain timer contact 10TR-3 which disconnects power line 307.

The repeating rocking action of the cradle assembly assists the dumping of excess molding mixture from the core or molding box during the shell core process. In addition to this repeating action, the combined core machine of the present invention includes a vibrator valve V12 which controls a core box vibrator 106 shown in FIG. 1A. This core box vibrator 106 vibrates the core or molding box when the cradle assembly 7 is in its dumping position to ensure that the excess molding mixture is dumped from the core or molding box. As shown in FIG. 3D, the vibrator valve V12 which controls the core box vibrator 106 is automatically controlled. Vibrator valve V12 is connected through vibrator foot switch S18 and vibrator control switch S14 to power line 307. Vibrator control switch S14 enables the machine operator to set the vibrator valve V12 in the automatic/off/manual mode. The vibrator foot switch S18 enables the machine operator to manually actuate the vibrator valve V12 at any time during or after the core making process.

The rollover cushion valve V13 is not connected to power line 307 and, as a result, is not effected by the opening of timer contact 10TR-3. As the cradle assembly rotates within 30° of its normal upright position, cam switch CS2 opens to turn off the cradle cushion valve V13 which slows or cushions the return of the cradle assembly 7. In addition, the cam switch CS2 again closes to actuate the rollover cushion valve V13 when the cradle assembly 7 reaches its normal upright position. The rollover cushion valve thus enables the cradle assembly 7 to achieve a more positive seating action.

As the cradle assembly returns to its normal upright position, the curing process is initiated by the closing of timer contact 10TR-2 which connects cure timer motor 11TR and cure timer clutch 11TC to power line 306 through shell mode relay contact 3CR-4. During the time period provided by timer motor 11TR, the molding mixture in the core or molding box is cured by the continued application of heat to the core box. This heat is supplied by the heating system shown in FIG. 2C and controlled by the control circuit shown in FIG. 3A. In addition, the closing of timer contact 10TR-2 actuates relay 8CR which opens relay contact 8CR-1 connected to automatic cycle relay 4CR. Upon expiration of the time period provided by cure timer motor 11TR, timer contact 11TR-1 opens to disconnect cure timer motor 11TR from the control circuit and timer contact 11TR-3 closes to actuate relay 10CR through normally closed relay contacts 7CR-6 and 2CR-8. Relay contact 10CR-5 closes to hold relay 10CR on. Relay 10CR enables the control circuit to end the automatic cycle by opening relay contact 10CR-1 connected to automatic cycle relay 4CR. In addition, relay contact 10CR-2 opens to disconnect the horizontal clamp valve V3 from the control circuit which enables the horizontal cylinder 73 to retract from its inward clamping position. Thus, the core or mold is ready for manual removal by the machine operator. Core removal can also be aided by manually closing the vibrator foot switch S18 connected to vibrator valve V12 which actuates the core box vibrator 106 shown in FIG. 1A.

Although the operation of the control circuit shown in FIGS. 3A–3D with respect to the shell core process is believed to be clear from the above description, a summary of the basic steps in the shell core process is useful to an understanding of this invention. When the machine operator starts the automatic cycle by setting selector switch S4 to the shell position and depressing start switches S5 and S6, the horizontal clamp valve V3 enables the horizontal clamp to clamp the core box and the sand magazine assembly 2 moves to its forward position due to the actuation of sand magazine arm valve V5. Vertical clamp cylinder 5 is then actuated by vertical valve V6 to clamp the blow head to the sand magazine assembly 2 and to clamp the sand magazine assembly 2 against the core or molding box. The blow valve V8 then actuates and blows sand from the magazine assembly 2 into the core box. The blow pressure is exhausted upon the actuation of exhaust pilot valve V7 and the vertical clamp 5 and the sand magazine arm assembly 2 return to their normal position as shown in FIG. 1A. The cradle assembly 7 then rotates due to the actuation of rollover valve V11 and a rocking action takes place to ensure good core drainage. At the same time, the core vibrator valve V12 enables the core box vibrator 106 to actuate and further ensure good core drainage. The sand return system valve V9 is also actuated to return the molding mixture previously dumped into sand return system 9 to the hopper mechanism 3. The cradle assembly 7 returns to its normal upright position for core curing under the control of timer 11TR. Upon completion of core curing, the automatic cycle ends and the horizontal clamp valve V3 is disconnected to allow the horizontal clamp to open and permit core removal by the machine operator.

The control circuit shown in FIGS. 3A–3D can also be programmed to automatically control the production of sand cores by the hot box process. The hot box process is very similar to the shell core process except that, because the cradle assembly 7 remains in its normal upright position, none of the molding mixture is dumped from the core or molding box. Thus, the sand cores formed during the hot box process are solid sand cores as opposed to the hollow sand cores formed during the shell core process. Since the operation of the control circuit 3 for the hot box process is similar to the shell core process, only the differences between these two processes will be described below with respect to the hot box process.

Referring now to FIG. 3A, the selector switch S4 is positioned by the machine operator in the hot box position and the automatic cycle switches S5 and S6 are actuated in the same manner as described previously. With the selector switch S4 in the hot box position, both the relays 2CR and 3CR are inactive. The horizontal clamp valve V3, the sand magazine arm valve V5, the vertical clamp valve V6, the blow pilot valve V8 and the exhaust pilot valve V7 are actuated in the same manner as described with respect to the shell core process. However, after the blow pilot valve V8 blows sand from the sand magazine assembly 2 into the core or molding box, the cure timer motor 11TR and the cure timer clutch 11TC are immediately actuated through normally closed relay contacts 2CR-5 and 3CR-5. The time period provided by the cure timer motor 11TR permits the molding mixture contained in the core or molding box to cure. At the same time, the reload timer motor 10TR and the reload timer clutch 10TC, which were previously used during the shell core process for dumping the excess molding mixture from the core or molding box, are actuated through normally closed relay contacts 2CR-3 and 3CR-3. As a result, the reload valve V10 is actuated through normally closed relay contact 3CR-7, timer relay contact 10TR-3 and timer clutch contact 10TC-1. The reload valve V10 is connected to the hopper vibrator for vibrating the hopper mechanism 3 shown in FIG. 1A to ensure the depositing of the molding mixture contained in the hopper mechanism 3 into the sand magazine assembly 2. Reload valve V10 was not utilized during the shell core process because molding mixtures generally used for shell core processes are dry mixtures which readily feed into the sand magazine assembly 2 due to the force of gravity. The molding mixtures normally used for hot box processes are wet mixtures which must be vibrated in order to ensure the depositing of the molding mixtures into the sand magazine assembly 2. A reload switch S12 is also connected to the reload valve V10 for setting the reload valve V10 for either the automatic or manual mode.

Upon completion of the reload process, reload timer motor contact 10TR-2 closes to actuate relay 8CR which opens relay contact 8CR-1 connected to automatic start relay 4CR. In addition, upon completion of the curing process, the cure timer contact 11TR-3 closes to actuate relay 10CR through normally closed relay contact 2CR-8, and normally closed relay contact 7CR-6. As described with respect to the shell core process, the actuation of relay 10CR terminates the automatic cycle by opening relay contact 10CR-1 and the horizontal clamp valve V3 is deenergized by the opening of relay contact 10CR-2. The machine operator then manually removes the hot box core, removal of which can be assisted by closing the vibrator foot switch S18 to actuate vibrator valve V12 which actuates core box vibrator 106.

During the hot box process, as distinguished from the shell core process, the dwell timer motor 9TR, the sand return system controlled by sand return system valve V9, and the automatic rollover system controlled by rollover valve V11 and rollover cushion valve V13 are not utilized. However, by using many of the other control elements in the control circuit for dual purposes, the control circuit of the present invention economizes on the number of necessary control elements. For example, the timer motor 10TR and the timer clutch 10TC, which were used during the shell core process to control the draining process, are used during the hot box process to control the reload process. Similarly, the same circuitry is utilized in both processes to control the sand magazine assembly 2, the vertical clamp assembly 5 and the blow valve system 6.

The combined core machine of the present invention is also capable of producing cold box cores. The control circuit shown in FIGS. 3A–3D automatically controls the combined core machine during the cold box core process. Most of the control circuit elements shown in FIGS. 3A–3D which are used for the shell core process and the hot box process are also used for the cold box process. Although some of these control circuit elements perform the same function previously described with respect to the shell core process and the hot box process, others are used to perform different functions during the cold box process. In this manner, the control circuit economizes on the number of different control circuit elements which must be programmed to enable the combined core machine to produce different types of sand cores. Thus, programming of the combined core machine of the present invention is greatly simplified.

Referring now to FIG. 3A, the combined core machine is set to perform the cold box process by setting the selector switch S4 to the cold box position. This actuates cold box relay 2CR connected thereto. In addition, the temperature control switch S1 must be set in the off position since heat is not required during the cold box process for curing the molding mixture. The machine operator next operates the start cycle switches S5 and S6 in the same manner as described with respect to the shell core process. The horizontal clamp valve V3, the sand magazine arm valve V5, the vertical clamp valve V6, the blow pilot valve V8 and the exhaust pilot valve V7 are all actuated by the automatic control circuit in the same manner as described with respect to the shell core process.

During the cold box process, upon the expiration of the time period provided by the blow exhaust timer 7TR, the relay 6CR and the gas arm delay timer 12TR are actuated. The delay time period provided by gas arm delay timer 12TR permits the vertical clamp assembly 5 and the sand magazine arm assembly 2 shown in FIG. 1A to substantially return to their normal positions prior to the movement of the gas magazine arm assembly 4. The vertical clamp assembly 5 returns to its normal position due to the opening of relay contact 6CR-3 connected to vertical clamp valve V6 and the sand magazine arm assembly 2 returns to its normal position due to the opening of relay contact 6CR-2 connected to sand magazine arm valve V5. Upon expiration of the time period provided by gas arm delay timer 12TR, the timer contact 12TR-1 is closed which actuates the gas arm valve V4 through relay contacts 2CR-1, 10CR-3 and 6CR-1. Normally open relay contact 2CR-1 prevents actuation of the gas arm valve V4 during the shell and hot box processes.

The actuation of gas arm valve V4 actuates gas arm cylinder 44 as shown in FIG. 2B and moves the gas magazine assembly 4 to its forward position over the core or molding box. As the gas arm assembly 4 reaches its forward position, the gas arm forward limit switch LS1(A) closes to actuate the vertical clamp delay timer 3TR and limit switch LS1(B) closes to actuate relay 7CR. These limit switches, which are positioned adjacent the gas magazine assembly 4, are closed in response to the movement of the gas magazine assembly 4 to its forward position. Relay contacts 7CR-1 and 7CR-2 close to ensure that the horizontal clamp valve V3 and the automatic cycle relay 4CR remain actuated. After the vertical clamp delay timer 3TR times out, the timer contact 3TR-1 closes to actuate the vertical clamp valve V6 and the gas delay timer 4TR through relay contact 7CR-3 and normally closed relay contact 10CR-4. The time period provided by vertical clamp delay timer 3TR permits the gas magazine assembly to come to rest in its forward position before the vertical clamp valve V6 is actuated. The vertical clamp valve V6 actuates the vertical clamp cylinder 5 shown in FIG. 2B which forces the blow head against the gas magazine assembly 4 which in turn forces the gas magazine assembly 4 against the core or molding box. The blow timer motor 5TR and the blow pilot valve V8, which were previously actuated to blow the molding mixture from the sand magazine assembly 2 into the core or molding box, are not actuated when the gas magazine assembly 4 is positioned over the core box. The timer contact 5TR-2 connected to blow timer motor 5TR and timer contact 5TR-1 connected to blow pilot valve V8 are both in the open position when the gas magazine assembly 4 is positioned over the core box.

At the same time the gas magazine assembly 4 is moved into its forward position, the reload timer 10TR and the reload timer clutch 10TC are actuated by the closing of sand arm rear limit switch LS3(A). This limit switch, which is positioned adjacent the sand magazine assembly 2, senses the return of the sand magazine assembly 2 to its normal rear position. The reload timer motor 10TR and the reload timer clutch 10TC are connected to power line 303 through relay contacts 2CR-4, 6CR-5 and 2CR-2 and sand arm rear limit switch LS3(A). The timer clutch 10TC closes timer clutch contact 10TC-1 which actuates the reload valve V10. The reload valve V10 actuates the hopper vibrator in the manner shown in FIG. 2B which vibrates the hopper mechanism 3 to refill the sand magazine with the molding mixture. As similarly described with respect to the hot box process, the molding mixture used in the cold box process is a wet mixture which must be vibrated in order to deposit the molding mixture into the sand magazine assembly 2.

As mentioned above, the gas delay timer 4TR and the vertical clamp valve V6 are actuated at the same time. The time period provided by gas delay timer 4TR permits the vertical clamp assembly 5 to move the gas magazine assembly 4 against the core box before the gas line 43 connected to the gas magazine assembly 4 is turned on. After timer 4TR times out, timer contact 4TR-2 closes to actuate low pressure gas timer 8TR through relay contact 7CR-4. In addition, low pressure gas valve V14 is actuated through timer contact 8TR-2 and power line 308. Power line 308 is connected to power line 303 through relay contact 7CR-4, timer contact 4TR-2, relay contact 6CR-5 and relay contact 2CR-2. A low pressure gas switch S15 is connected to low pressure gas valve V14 for setting the low pressure gas valve V14 for the automatic or manual mode. By first introducing the gas catalyst to the core box at a low pressure, the combined core machine of the present invention prevents the disruption of the molding mixture in the cold box as would occur if the gas catalyst was introduced at a high pressure. After the molding mixture is sufficiently set or cured by the introduction of the low pressure gas catalyst to prevent any high pressure disruptive effect, the timer 8TR times out and the low pressure gas valve V14 is shut off by the opening of timer contact 8TR-2. At the same time, the high pressure gas timer motor 9TR and the high pressure timer clutch 9TC are actuated by the closing of timer contact 8TR-1. The high pressure gas valve V15 is actuated by the closing of timer clutch contacts 9TC-1 and 9TC-2. High pressure gas switch S16 and timer clutch contact 11TC-1, which are connected between high pressure gas valve V15 and power line 308, are normally closed. The high pressure gas switch S16 can be set for automatic or manual operation of the high pressure gas valve V15.

When the high pressure gas timer motor 9TR times out, the timer contact 9TR-1 connected to high pressure gas timer motor 9TR is opened and the timer contact 9TR-2 is closed to actuate purge timer motor 11TR and purge timer clutch 11TC through relay contact 2CR-6. As a result, timer clutch contact 11TC-1 opens to disable the high pressure gas valve V15 and timer clutch contact 11TC-2 closes to actuate air purge valve V16 through air purge switch S17, relay contact 2CR-7 and timer contact 11TR-2. The air purge valve V16 remains actuated until the purge timer motor 11TR times out which causes the timer contact 11TR-1 connected thereto and the timer contact 11TR-2 connected to the air purge valve V16 to open.

Upon completion of the purging of the gas catalyst from the gas arm assembly 4 and the core or molding box, the control circuit terminates the automatic cycle. The purge timer contact 11TR-3 closes and the purge exhaust timer 7TR is actuated through power line 309 and relay contacts 6CR-6 and 4CR-5. When timer 7TR times out, the timer contact 7TR-2 closes and the relay 10CR is actuated. The opening of relay contact 10CR-4 disables the vertical clamp valve V6 which permits the vertical clamp cylinder 5 to retract and the opening of relay contact 10CR-3 disables gas arm valve V4 which permits gas arm magazine assembly 4 to return to its normal position. As the gas arm assembly 4 moves towards its normal position, the gas arm forward limit switch LS1(B) connected to relay 7CR opens and the relay 7CR is inactivated. The opening of relay contact 7CR-1 together with the opening of relay contact 10CR-2 connected in parallel therewith disables the horizontal clamp valve V3 which causes the horizontal clamp cylinder to release the core or molding box. The opening of relay contacts 10CR-1, 8CR-1 and 7CR-2 disables the automatic cycle relay 4CR and terminates the automatic cycle.

Although the operation of the combined core machine during the cold box process is described above in detail, a summary of the basic steps in the cold box process is useful to an understanding of this invention. When the machine operator starts the automatic cycle by setting selector switch S4 in the cold box position and depressing start switches S5 and S6, the horizontal clamp valve V3 enables the horizontal clamp to clamp the core or molding box in the cradle assembly 7. The sand magazine assembly 2 then moves to its forward position due to the actuation of sand magazine arm valve V5. Vertical clamp cylinder 5 is then actuated by vertical clamp valve V6 which forces the blow head against the sand magazine assembly 2 which in turn forces the sand magazine assembly against the core box. The blow valve V8 then actuates and blows sand from the magazine assembly 2 into the core box. The blow pressure is exhausted upon the actuation of exhaust pilot valve V7 and then both the vertical clamp 5 and the sand magazine arm assembly 2 retract to their normal position as shown in FIG. 1A. The reload valve V10 now is actuated and the hopper is energized to refill the sand magazine assembly 2 for the next cycle. At the same time, the gas arm valve V4 is actuated which moves gas magazine assembly 4 to its forward position over the core or molding box. Although the vertical clamp cylinder 5 is again actuated by vertical clamp valve V6 to force the blow head against the gas magazine assembly 4 which in turn forces the gas magazine assembly 4 against the core box, the blow valve V8 is not actuated. The low pressure gas timer 8TR and the low pressure gas valve V14, the high pressure gas timer 9TR and the high pressure gas valve V15, and the purge timer motor 11TR and the purge valve V16 are successively actuated by the control circuit. After the air purge timer motor 11TR times out and the air purge valve V16 is deenergized, the vertical clamp cylinder 5 and the gas arm assembly 4 retract to their normal position. The automatic cycle is terminated as the horizontal clamp opens to permit manual removal of the core or mold by the machine operator. Core removal can be facilitated by actuating the core box vibrator 106 by closing the vibrator foot switch S18 connected to vibrator valve V12.

In summary, according to the present invention, a combined core machine can be conveniently and simply programmed to produce any one of several different types of rigid sand cores including shell cores, hot box cores and cold box cores. Conversion from one process to another requires very little mechanical change and, because of the multiple functions performed by the timer circuits contained in the control circuit, only a small number of timers need to be reset to program the control circuit for the different processes. For example, in converting from the shell process to the cold box process, timers 9TR, 10TR and 11TR, which control the draining and curing of the molding mixture during the shell process, must be reset for different time periods because these timers perform entirely different functions during the cold box process. In the cold box process these same timers are used to control the supplying and purging of the gas catalyst and the reloading of the hopper mechanism. In addition to these timers, timers 4TR and 7TR, which each perform a single function during the shell process, each perform different two functions during the cold box process. However, because of the similarity of these dual functions, these timers need not be reset in converting from the shell process to the cold box process. Finally, it is desirable to reset timer 5TR, which controls the blow valve assembly 6, because the time period required to blow the dry molding mixture of the shell process into the core box usually is different than the time period required for the wet molding mixture of the cold box process. According to the present invention, only four timers, timers 5TR, 9TR, 10TR and 11TR, must be reprogrammed for conversion from one process to another. These timers are conveniently accessible to the machine operator as shown on the control box 1 of FIG. 1A.

Although illustrative embodiments of the invention have been described in detail with reference to the accompanying drawings, it is to be understood that the invention is not limited to those precise embodiments and that various changes and modifications may be made therein by one skilled in the art without departing from the scope or spirit of the invention.

I claim:

1. A machine for producing rigid sand cores to be used in metal casting from a molding mixture comprising a refractory granular material such as sand and a relatively small quantity of a hardenable binder, said machine comprising in combination:

a frame;

a core box having at least one opening therein for receiving the molding mixture;

support means mounted on said frame supporting said core box;

depositing means mounted on said frame adjacent said opening in said core box for depositing the molding mixture in said core box;

shell core producing means for producing hollow shell cores from the molding mixture in said core box, said shell core producing means including draining means forming part of said support means for rotating said core box to drain excess molding mixture from said core box in order to leave a thin coating of the molding mixture in said core box and heating means mounted on said support means adjacent said core box for heating said core box to cure the molding mixture in said core box;

cold box core producing means for producing cold box cores from the molding mixture in said core box, said cold box core producing means including gas means mounted on said frame to engage said core box for passing gas through said core box to cure the molding mixture in said core box and purging means connected to said gas means for purging the gas in said core box;

programmable control circuit means operative for automatically operating said shell core producing means and said cold box core producing means, said programmable control circuit means including selector switch means positionable for selecting one of said shell core producing means or said cold box core producing means for automatic operation to enable said machine to produce either shell cores or cold box cores during any one automatic cycle.

2. The machine according to claim 1 wherein said programmable control circuit means further comprises a power supply and a shell mode relay connected to said power supply by said selector switch means for actuating a plurality of shell mode relay contacts to automatically control the sequence and duration of operation of said shell core producing means upon positioning said selector switch means for production of shell cores.

3. The machine according to claim 2 wherein said programmable control circuit means further comprises a cold box mode relay connected to said power supply by said selector switch means for actuating a plurality of cold box mode relay contacts to automatically control the sequence and duration of operation of said cold box core producing means upon positioning said selector switch means for production of the cold box cores.

4. The machine according to claim 3 wherein said programmable control circuit means further comprises timer means connected to said power supply by said shell mode relay contacts and said cold box mode relay contacts for actuation by said shell mode relay to control said shell core producing means during production of shell cores or by said cold box mode relay to control said cold box core producing means during production of cold box cores, said timer means comprising a plurality of timers individually programmable to automatically control production of shell cores or cold box cores during any one automatic cycle.

5. A machine for producing rigid sand cores to be used in metal casting from a molding mixture comprising a refractory granular material such as sand and a relatively small quantity of a hardenable binder, said machine comprising in combination:

a frame;

a core box having at least one opening therein for receiving the molding mixture;

support means mounted on said frame supporting said core box;

depositing means mounted on said frame adjacent said opening in said core box for depositing the molding mixture in said core box;

draining means forming part of said support means for rotating said core box to drain excess molding mixture from said core box in order to leave a thin coating of the molding mixture in said core box; heating means mounted on said support means adjacent said core box for heating said core box to cure the molding mixture in said core box;

gas means mounted on said frame to engage said core box for passing gas through said core box to cure the molding mixture in said core box; purging means mounted on said frame and connected to said gas means for purging the gas in said core box; and programmable control circuit means operative for selectively operating said depositing means, said draining means, said heating means, said gas means and said purging means to automatically produce shell cores, hot box cores or cold box cores during any one automatic cycle, said programmable control circuit means including selector switch means positionable for programming said programmable control circuit means to produce shell cores, cold box cores or hot box cores.

6. The machine according to claim 5 wherein said programmable control circuit means further comprises a power supply and a shell mode relay connected to said power supply by said selector switch means for actuating a plurality of shell mode relay contacts to automatically control the sequence and duration of operation of said draining means and said heating means upon positioning said selector switch means for production of shell cores.

7. The machine according to claim 6 wherein said programmable control circuit means further comprises a cold box mode relay connected to said power supply by said selector switch means for actuating a plurality of cold box mode relay contacts to automatically control the sequence and duration of operation of said gas means and said purging means upon positioning said selector switch means for production of cold box cores.

8. The machine according to claim 7 wherein said programmable control circuit means further comprises timer means connected to said power supply by said shell mode relay contacts and said cold box mode relay contacts for actuation by said shell mode relay to control said draining means and said heating means during production of shell cores or by said cold box mode relay to control said gas means and said purging means during production of cold box cores, said timer means comprising a plurality of timers individually programmable to automatically control production of shell cores or cold box cores during any one automatic cycle.

9. The machine according to claim 7 wherein said selector switch means inactivates both said shell mode relay and said cold box mode relay upon positioning said selector switch means for production of hot box cores.

10. The machine according to claim 9 wherein said selector switch means comprises a three position switch.

11. The machine according to claim 9 wherein said programmable control circuit means further comprises first timer means connected to said power supply by said shell mode relay contacts and said cold box mode relay contacts, said first timer means being actuated by said shell mode relay during production of shell cores for delaying the operation of said draining means for a predetermined time period to enable said heating means to begin curing the molding mixture in said core box in order to leave a thin coating of the molding mixture in said core box, said first timer means being actuated by said cold box mode relay during production of cold box cores for operating said gas means, said first timer means being reprogrammable for different time periods during production of shell cores and cold box cores.

12. The machine according to claim 11 wherein said programmable control circuit means further comprises second timer means connected to said power supply by said shell mode relay contacts and said cold box mode relay contacts, said second timer means being actuated by said shell mode relay during production of shell cores for operating said draining means, said second timer means being actuated by said cold box mode relay during production of cold box cores, said second timer means being reprogrammable for different time periods during production of shell cores and cold box cores.

13. The machine according to claim 12 wherein said depositing means comprises:

hopper means mounted on said frame for holding a supply of the molding mixture;

sand magazine means movable from a position beneath said hopper means to a position adjacent said opening in said core box for transporting a predetermined quantity of the molding mixture to said core box;

a hopper vibrator mounted on said hopper means for vibrating said hopper means to deposit the molding mixture held in said hopper means into said sand magazine means, wherein said programmable control circuit means further comprises a reload operating valve actuated by said second timer means during production of cold box cores for activating said hopper vibrator.

14. The machine according to claim 13 wherein said second timer means actuates said reload operating valve to activate said hopper vibrator during production of hot box cores, said second timer means being actuated as a result of the inactivation of both said shell mode relay and said cold box mode relay by said selector switch means during production of hot box cores, said second timer means being reprogrammable for different time periods during production of shell cores, cold box cores or hot box cores.

15. The machine according to claim 12 wherein said draining means comprises:

clamp means rotatably mounted on said support means for clamping said core box;

a forward rollover cylinder attached to said clamp means for rotating said clamp means in a first direction to drain the excess molding mixture from said core box; and a rear rollover cylinder attached to said clamp means for rotating said clamp means in a second direction to return said core box to its normal upright position, wherein said programmable control circuit means further comprises a rollover operating valve actuated by said second timer means during production of shell cores for operating said forward rollover cylinder and said rear rollover cylinder.

16. The machine according to claim 15 wherein said programmable control circuit means further comprises cam switch means mounted on said support means and connected to said rollover operating valve for sensing the position of said clamp means to control the actuation of said rollover operating valve.

17. The machine according to claim 16 wherein said programmable control circuit further comprises switching means responsive to said cam switch means for periodically actuating said rollover operating valve to rock said clamp means and said core box back and forth in its upside down position to drain the excess molding mixture from said core box.

18. The machine according to claim 17 wherein said cam switch means comprises a first and second cam switch connected in series with said switching means, said switching means comprising a relay having a relay coil connected in series with said first and second cam switchs, a first normally closed relay contact connected in series with said rollover operating valve and a second normally open relay contact connected in parallel with said first cam switch, said first cam switch being in the closed position in the extreme rollover position of said clamp means and said second cam switch being in the closed position before said clamp means reaches its extreme rollover position, said first and second cam switches periodically actuating said relay which in turn periodically actuates said rollover operating valve to rock said clamp means and said core box back and forth until the expiration of the time period provided by said second timer means.

19. The machine according to claim 12 further comprising molding mixture return means mounted on said frame beneath said support means and said core box for returning the excess molding mixture drained from said core box by said draining means to said depositing means, wherein said programmable control circuit means further comprises a return system valve actuated by said second timer means during production of shell cores for operating said molding mixture return means.

20. The machine according to claim 12 wherein said draining means further comprises vibrator means mounted on said support means adjacent said core box for vibrating said core box to assist in the draining of the excess molding mixture from said core box, wherein said programmable control circuit means further comprises a vibrator operating valve actuated by said second timer means during production of shell cores for operating said vibrator means.

21. The machine according to claim 12 wherein said programmable control circuit means further comprises third timer means connected to said power supply by said shell mode relay contacts and said cold box mode relay contacts, said third timer means being actuated by said shell mode relay during production of shell cores for setting the time period for the application of heat to said core box by said heating means to cure the molding mixture in said core box, said third timer means being actuated by said cold box mode relay during production of cold box cores for operating said purging means, said third timer means being reprogrammable for different time periods during production of shell cores and cold box cores.

22. The machine according to claim 21 wherein said third timer means sets the time period for the application of heat to said core box by said heating means to cure the molding mixture in said core box during production of hot box cores, said third timer means being actuated as a result of the inactivation of both said shell mode relay and said cold box mode relay by said selector switch means during production of hot box cores, said third timer means being reprogrammable for different time periods during production of shell cores, cold box cores or hot box cores.

23. The machine according to claim 5 wherein said programmable control circuit means further comprises:

a power supply;

start switch means connected to said power supply for starting a automatic cycle;

a deposit control circuit connected to said start switch means for automatically controlling the operation of said depositing means during an automatic cycle.

24. The machine according to claim 5 wherein said depositing means comprises:

hopper means mounted on said frame for holding a supply of the molding mixture;

sand magazine means movable from a position beneath said hopper means to a position adjacent said opening in said core box for transporting a predetermined quantity of the molding mixture to said core box;

blow means mounted on said frame to engage said sand magazine means upon being positioned adjacent said opening in said core box for blowing compressed air into said sand magazine means to force the molding mixture from said sand magazine means into said core box;

vertical clamp means mounted on said blow means for forcing said blow means against said sand magazine means which in turn forces said sand magazine means against said core box to form a closed chamber for blowing the molding mixture into said core box; and exhaust means mounted on said blow means for releasing the compressed air from said blow means.

25. The machine according to claim 24 wherein said programmable control circuit means further comprises:

a power supply;

start switch means connected to said power supply for starting an automatic cycle;

sand magazine timer and valve means connected to said power supply by said start switch means for automatically operating said sand magazine means;

vertical clamp timer and valve means connected to said power supply means by said start switch means and responsive to the position of said sand magazine means for automatically operating said vertical clamp means after said sand magazine means is positioned adjacent said opening in said core box;

blow timer and valve means actuated by said vertical clamp timer and valve means for automatically operating said blow means for a predetermined time period, said blow timer and valve means being reprogrammable to provide different time periods for production of shell cores, hot box cores, or cold box cores; and exhaust timer and valve means actuated by said blow timer and valve means for automatically operating said exhaust means after the operation of said blow means.

26. The machine according to claim 5 wherein said support means comprises horizontal clamp means for clamping said core box and said programmable control circuit means further comprises horizontal clamp control means for automatically enabling said horizontal clamp means to clamp said core box at the beginning of an automatic cycle and release said core box at the end of the automatic cycle.

27. The machine according to claim 5 wherein said programmable control circuit means further comprises a power supply and a cold box mode relay connected to said power supply by said selector switch means for actuating a plurality of cold box mode relay contacts to automatically control the sequence and duration of operation of said gas means and said purging means upon positioning said selector switch means for production of cold box cores.

28. The machine according to claim 27 wherein said gas means comprises:

a gas supply means;

gas magazine means mounted on said frame for connecting said gas supply means to said core box, said gas magazine means being movable into engagement with said core box; and a gas line connected between said gas supply means and said gas magazine means having a low pressure gas valve for passing gas to said gas magazine means at low pressure and a high pressure gas valve for passing gas to said gas magazine means at high pressure, wherein said programmable control circuit means further comprises:

gas magazine control means actuated by said cold box mode relay for automatically moving said gas magazine means into engagement with said core box after the molding mixture is deposited in said core box by said depositing means;

low pressure control means actuated by said cold box mode relay and responsive to the position of said gas magazine means for automatically operating said low pressure gas valve; and high pressure control means actuated by said low pressure control means for automatically operating said high pressure gas valve for passing gas to said gas magazine means at high pressure to cure the molding mixture in said core box.

29. The machine according to claim 28 wherein said purging means comprises a source of compressed air connected to said gas line by a compressed air valve and wherein said programmable control circuit means further comprises purging control circuit means actuated by said cold box mode relay and said high pressure control means for actuating said compressed air valve for a predetermined time period to purge the gas from said core box.

30. The machine according to claim 29 wherein said programmable control circuit means further comprises reset means actuated by said purging control circuit means for resetting said programmable control circuit.

* * * * *